US011020968B2

(12) United States Patent
Ai et al.

(10) Patent No.: US 11,020,968 B2
(45) Date of Patent: Jun. 1, 2021

(54) HEAD CHIP, LIQUID JET HEAD, LIQUID JET RECORDING DEVICE, AND METHOD OF MANUFACTURING HEAD CHIP

(71) Applicant: SII Printek Inc., Chiba (JP)

(72) Inventors: Tomoki Ai, Chiba (JP); Yuki Yamamura, Chiba (JP); Tooru Mine, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 16/670,422

(22) Filed: Oct. 31, 2019

(65) Prior Publication Data

US 2020/0147964 A1 May 14, 2020

(30) Foreign Application Priority Data

Nov. 9, 2018 (JP) ..... JP2018-211523

(51) Int. Cl.
*B41J 2/14* (2006.01)
*B41J 2/16* (2006.01)

(52) U.S. Cl.
CPC ..... *B41J 2/14201* (2013.01); *B41J 2/1607* (2013.01); *B41J 2/1623* (2013.01)

(58) Field of Classification Search
CPC .... B41J 2/14201; B41J 2/1607; B41J 2/1623; B41J 29/13; B41J 2/17509; B41J 2/1642; B41J 2/1632; B41J 2/1609; B41J 2/14209; B41J 2/18; B41J 2002/14491; B41J 2202/12; B41J 2/01; B41J 2/14; B41J 2/1621
See application file for complete search history.

(56) References Cited

U.S. PATENT DOCUMENTS 8,091,987 B2 1/2012 Van Der Bergen
2017/0087840 A1 3/2017 Nishikawa et al.

FOREIGN PATENT DOCUMENTS

JP 2015-085534 A 5/2015

OTHER PUBLICATIONS

IP.com search (Year: 2020).*
Extended European Search Report in Europe Application No. 19208092.7, dated Mar. 31, 2020, 8 pages.

* cited by examiner

*Primary Examiner* — Lisa Solomon
(74) *Attorney, Agent, or Firm* — Brinks Gilson & Lione

(57) ABSTRACT

There are provided a head chip and a method of manufacturing the same, a liquid jet head, and a liquid jet recording device each capable of suppressing a stray capacitance to improve the image quality. The head chip according to an embodiment of the present disclosure is a head chip having an actuator plate adapted to apply pressure to liquid to jet the liquid. The actuator plate includes an obverse surface and a reverse surface, a channel extending in a predetermined direction and having a first opening provided to the obverse surface and a second opening which is provided to the reverse surface and is shorter in length in the predetermined direction than the first opening, and an electrode having an obverse surface side part disposed on a sidewall of the channel on the first opening side, and a reverse surface side part which is disposed on the sidewall closer to the second opening than the obverse surface side part and is one of equal to and larger than the obverse surface side part in size in the predetermined direction.

10 Claims, 17 Drawing Sheets

HEAD CHIP, LIQUID JET HEAD, LIQUID JET RECORDING DEVICE, AND METHOD OF MANUFACTURING HEAD CHIP

RELATED APPLICATIONS

This application claims priority to Japanese Patent Application Nos. 2018-211523 filed on Nov. 9, 2018, the entire content of which is incorporated herein by reference.

BACKGROUND OF THE INVENTION

1. Field of the Invention

The present disclosure relates to a head chip, a method of manufacturing the same, a liquid jet head, and a liquid jet recording device.

2. Description of the Related Art

As one of liquid jet recording devices, there is provided an inkjet type recording device for ejecting (jetting) ink (liquid) on a recording target medium such as recording paper to perform recording of images, characters, and so on (see, e.g., the specification of U.S. Pat. No. 8,091,987).

In the liquid jet recording device of this type, it is arranged so that the ink is supplied from an ink tank to an inkjet head (a liquid jet head), and then the ink is ejected from nozzle holes of the inkjet head toward the recording target medium to thereby perform recording of the images, the characters, and so on. Further, such an inkjet head is provided with a head chip for ejecting the ink.

In such a head chip and so on, for example, there is a possibility that the ejection speed varies due to a stray capacitance, and thus, the image quality degrades. Therefore, it is desirable to provide a head chip and a method of manufacturing the same, a liquid jet head, and a liquid jet recording device each capable of suppressing the stray capacitance to improve the image quality.

SUMMARY OF THE INVENTION

The head chip according to an embodiment of the present disclosure is a head chip adapted to jet liquid including an actuator plate adapted to apply pressure to the liquid, wherein the actuator plate includes an obverse surface and a reverse surface, a channel extending in a predetermined direction, and having a first opening provided to the obverse surface and a second opening which is provided to the reverse surface and is shorter in length in the predetermined direction than the first opening, and an electrode having an obverse surface side part disposed on a sidewall of the channel on the first opening side, and a reverse surface side part which is disposed on the sidewall closer to the second opening than the obverse surface side part and is one of equal to and larger than the obverse surface side part in size in the predetermined direction.

The liquid jet head according to an embodiment of the present disclosure includes the head chip according to an embodiment of the disclosure, and a supply mechanism adapted to supply the liquid to the head chip.

The liquid jet recording device according to an embodiment of the present disclosure includes the liquid jet head according to an embodiment of the present disclosure, and a containing section adapted to contain the liquid.

The method of manufacturing a head chip according to an embodiment of the present disclosure is a method of manufacturing a head chip including an actuator plate adapted to apply pressure to liquid so as to jet the liquid, the method including forming the actuator plate, the forming the actuator plate including providing a piezoelectric substrate having an obverse surface and a reverse surface with a channel which extends in a predetermined direction and has a first opening on the obverse surface, covering both end parts of the first opening in the predetermined direction with a mask, evaporating a conductive material on a sidewall of the channel from the first opening provided with the mask so as to form a first evaporation part, grinding the reverse surface of the piezoelectric substrate so as to reach the channel, to thereby form a second opening shorter in length in the predetermined direction than the first opening on the reverse surface side of the piezoelectric substrate, and evaporating the conductive material on the sidewall of the channel from the second opening so as to form a second evaporation part, to thereby form an electrode including the first evaporation part and the second evaporation part.

According to the head chip, the method of manufacturing the same, the liquid jet head, and the liquid jet recording device related to an embodiment of the present disclosure, it becomes possible to suppress the stray capacitance to improve the image quality.

BRIEF DESCRIPTION OF THE DRAWINGS

FIG. 9A is a flow chart showing an example of a method of manufacturing the liquid jet head shown in FIG. 3 and so on.

DETAILED DESCRIPTION OF THE PREFERRED EMBODIMENTS

An embodiment of the present disclosure will hereinafter be described in detail with reference to the drawings. It should be noted that the description will be presented in the following order:

1. Embodiment (a side-shoot type liquid jet head in which an actuator plate is provided with an electrode including an obverse side part and a reverse side part)
2. Modified Example (an example of an edge-shoot type liquid jet head)
3. Other Modified Examples <1. Embodiment>

[Overall Configuration of Printer 1]

Figure 1:
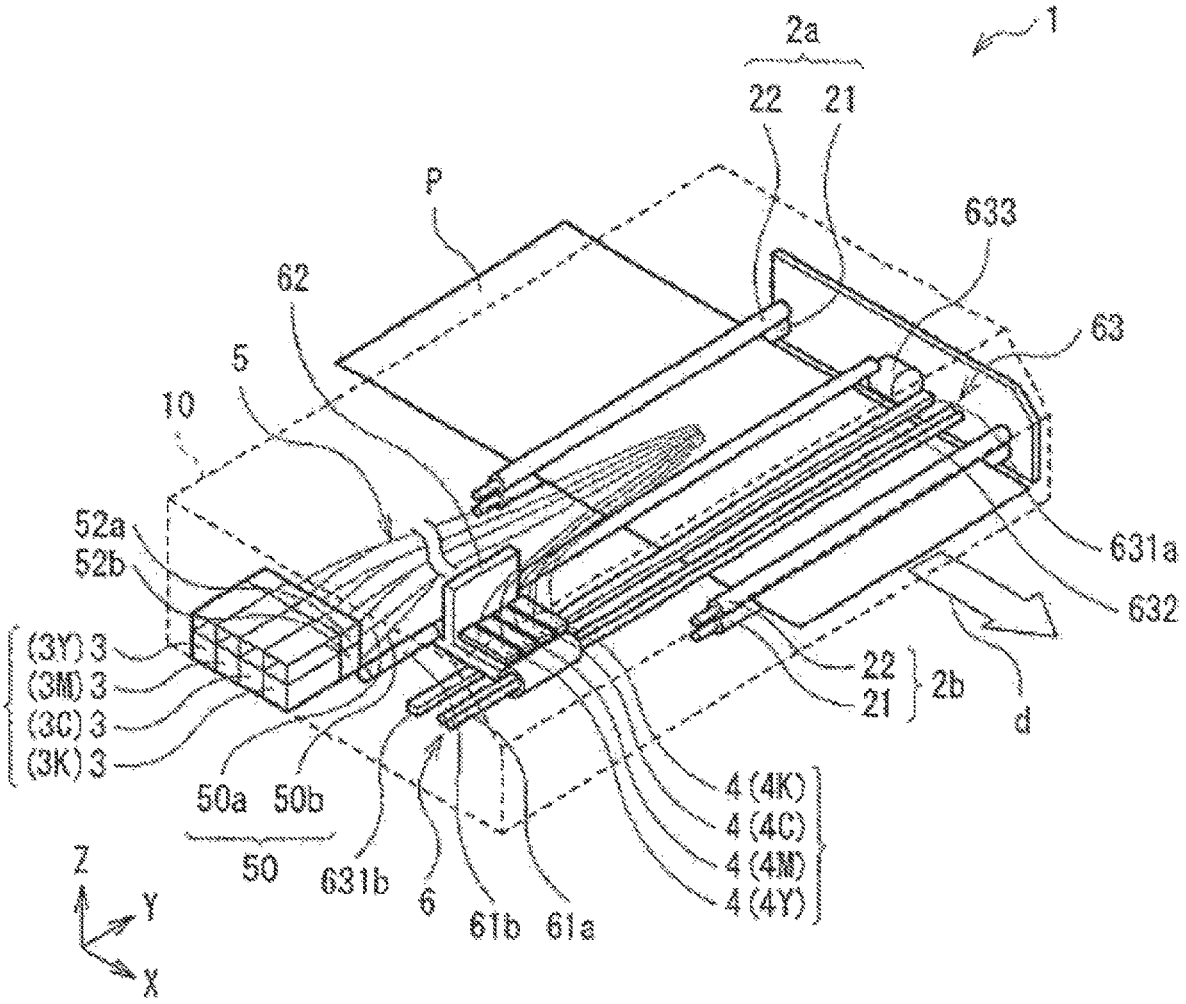
FIG. 1 is a schematic perspective view showing a schematic configuration example of a liquid jet recording device according to an embodiment of the present disclosure.

FIG. 1 is a perspective view schematically showing a schematic configuration example of a printer 1 according to an embodiment of the present disclosure. The printer 1 corresponds to a specific example of a "liquid jet recording device" in the present disclosure. The printer 1 is an inkjet printer for performing recording (printing) of images, characters, and the like on recording paper P as a recording target medium using ink 9 described later. Although the details will be described later, the printer 1 is also an ink circulation type inkjet printer using the ink 9 being circulated through a predetermined flow channel.

As shown in FIG. 1, the printer 1 is provided with a pair of carrying mechanisms 2*a*, 2*b*, ink tanks 3, inkjet heads 4, circulation mechanisms 5 and a scanning mechanism 6. These members are housed in a housing 10 having a predetermined shape. It should be noted that the scale size of each of the members is accordingly altered so that the member is shown large enough to recognize in the drawings used in the description of the specification. The inkjet heads 4 (inkjet heads 4Y, 4M, 4C and 4K described later) correspond to a specific example of a "liquid jet head" in the present disclosure.

(Carrying Mechanisms 2*a*, 2*b*)

The carrying mechanisms 2*a*, 2*b* are each a mechanism for carrying the recording paper P along the carrying direction d (an X-axis direction) as shown in FIG. 1. These carrying mechanisms 2*a*, 2*b* each have a grit roller 21, a pinch roller 22 and a drive mechanism (not shown). The grit roller 21 and the pinch roller 22 are each disposed so as to extend along a Y-axis direction (the width direction of the recording paper P). The drive mechanism is a mechanism for rotating (rotating in a Z-X plane) the grit roller 21 around an axis, and is configured using, for example, a motor.

(Ink Tanks 3)

The ink tanks 3 are each a tank for containing the ink 9 to be supplied to the corresponding inkjet head 4. The ink 9 corresponds to a specific example of a "liquid" in the present disclosure. The ink tanks 3 are each a tank for containing the ink 9 inside. As the ink tanks 3, there are disposed 4 types of tanks for individually containing 4 colors of ink 9, namely yellow (Y), magenta (M), cyan (C), and black (K), in this example as shown in FIG. 1. Specifically, there are disposed the ink tank 3Y for containing the yellow ink 9, the ink tank 3M for containing the magenta ink 9, the ink tank 3C for containing the cyan ink 9, and the ink tank 3K for containing the black ink 9. These ink tanks 3Y, 3M, 3C, and 3K are arranged side by side along the X-axis direction inside the housing 10. It should be noted that the ink tanks 3Y, 3M, 3C, and 3K have the same configuration except the color of the ink 9 contained, and are therefore collectively referred to as ink tanks 3 in the following description. The ink tanks 3 each correspond to a specific example of a "containing section" in the present disclosure.

(Inkjet Heads 4)

The inkjet heads 4 are each a head for jetting (ejecting) the ink 9 shaped like a droplet from a plurality of nozzle holes (nozzle holes H1, H2) described later to the recording paper P to thereby perform recording of images, characters, and so on. As the inkjet heads 4, there are also disposed four types of heads for individually jetting the four colors of ink 9 respectively contained in the ink tanks 3Y, 3M, 3C, and 3K described above in this example as shown in FIG. 1. Specifically, there are disposed the inkjet head 4Y for jetting the yellow ink 9, the inkjet head 4M for jetting the magenta ink 9, the inkjet head 4C for jetting the cyan ink 9, and the inkjet head 4K for jetting the black ink 9. These inkjet heads 4Y. 4M, 4C and 4K are arranged side by side along the Y-axis direction inside the housing 10.

It should be noted that the inkjet heads 4Y, 4M, 4C and 4K have the same configuration except the color of the ink 9 used therein, and are therefore collectively referred to as inkjet heads 4 in the following description. Further, the detailed configuration of the inkjet heads 4 will be described later (FIG. 3 through FIG. 8).

(Circulation Mechanisms 5)

Figure 2:
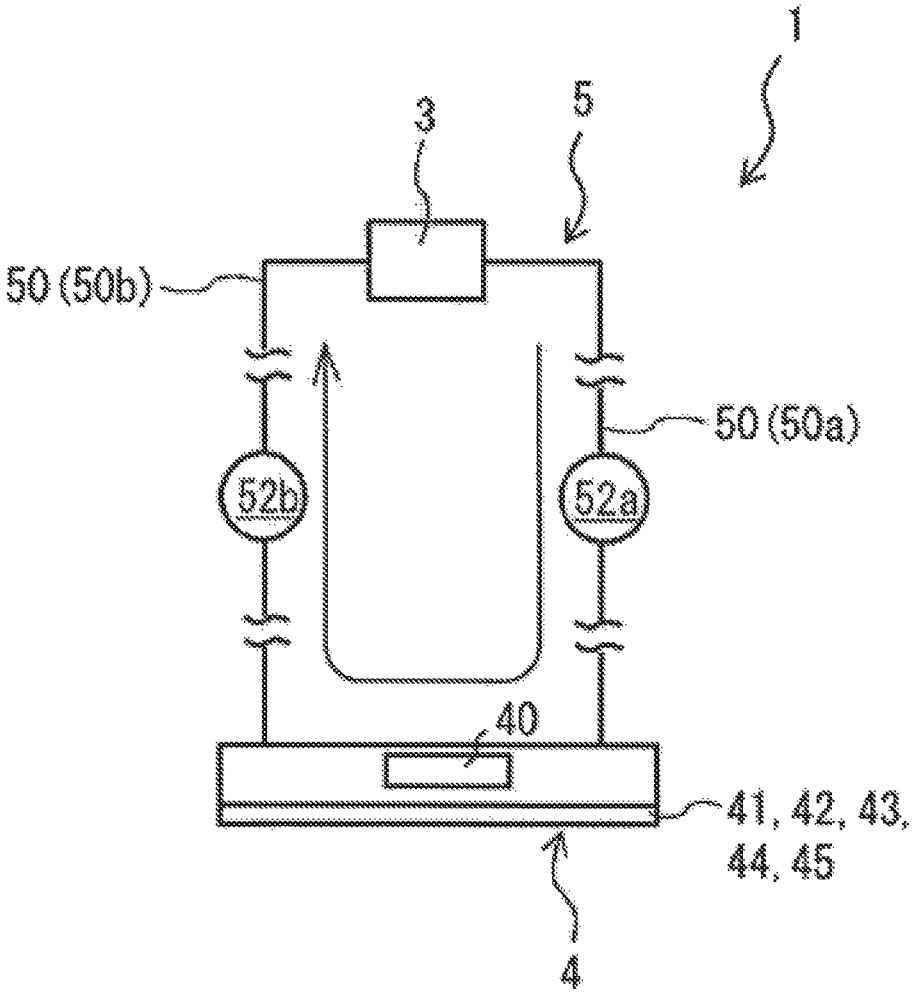
FIG. 2 is a schematic diagram showing a detailed configuration example of a circulation mechanism and so on shown in FIG. 1.

The circulation mechanisms 5 are each a mechanism for circulating the ink 9 between the inside of the ink tank 3 and the inside of the inkjet head 4. FIG. 2 is a diagram schematically showing a configuration example of the circulation mechanism 5 together with the ink tank 3 and the inkjet head 4. It should be noted that the solid arrow described in FIG. 2 indicates the circulation direction of the ink 9. As shown in FIG. 2, the circulation mechanism 5 is provided with a predetermined flow channel (a circulation channel 50) for circulating the ink 9, and a pair of liquid feeding pumps 52*a*, 52*b*.

The circulation channel 50 is a flow channel of circulating between the inside of the inkjet head 4 and the outside (the inside of the ink tank 3) of the inkjet head 4, and is arranged that the ink 9 circularly flows through the circulation channel 50. The circulation channel 50 has, for example, a flow channel 50*a* as a part extending from the ink tank 3 to the inkjet head 4, and a flow channel 50*b* extending from the inkjet head 4 to the ink tank 3. In other words, the flow channel 50*a* is a flow channel through which the ink 9 flows from the ink tank 3 toward the inkjet head 4. Further, the flow channel 50*b* is a flow channel through which the ink 9 flows from the inkjet head 4 toward the ink tank 3.

The liquid feeding pump 52*a* is disposed on the flow channel 50*a*, between the ink tank 3 and the inkjet head 4.

The liquid feeding pump 52*a* is a pump for feeding the ink 9 contained inside the ink tank 3 to the inside of the inkjet head 4 via the flow channel 50*a*. The liquid feeding pump 52*b* is disposed on the flow channel Sob between the inkjet head 4 and the ink tank 3. The liquid feeding pump 52*b* is a pump for feeding the ink 9 contained inside the inkjet head 4 to the inside of the ink tank 3 via the flow channel 50*b*.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 61*a*, 61*b* disposed so as to extend along the Y-axis direction, a carriage 62 movably supported by these guide rails 61*a*, 61*b*, and a drive mechanism 63 for moving the carriage 62 along the Y-axis direction. Further, the drive mechanism 63 has a pair of pulleys 631*a*, 631*b* disposed between the guide rails 61*a*, 61*b*, an endless belt 632 wound between the pair of pulleys 631*a*, 631*b*, and a drive motor 633 for rotationally driving the pulley 631*a*.

The pulleys 631*a*, 631*b* are respectively disposed in areas corresponding to the vicinities of both ends in each of the guide rails 61*a*, 61*b* along the Y-axis direction. To the endless belt 632, there is coupled the carriage 62. On the carriage 62, the four types of inkjet heads 4Y, 4M, 4C and 4B described above are disposed so as to be arranged side by side along the Y-axis direction. It should be noted that such a scanning mechanism 6 and the carrying mechanisms 2*a*, 2*b* described above constitute a moving mechanism for moving the inkjet heads 4 relatively to the recording paper P.

[Detailed Configuration of Inkjet Head 4]

Figure 3:
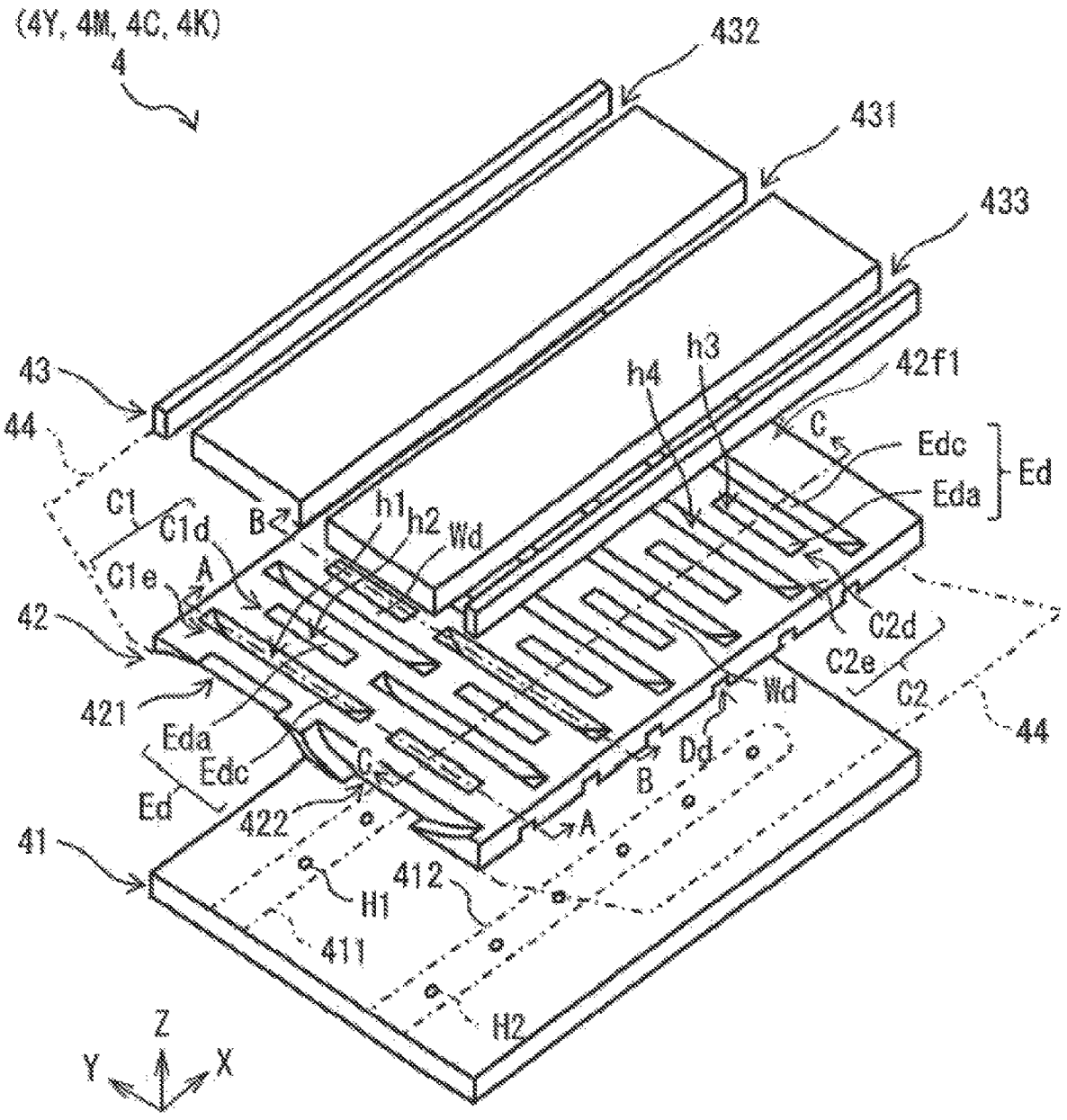
FIG. 3 is an exploded perspective view showing a detailed configuration example of the liquid jet head shown in FIG. 2.
Figure 4:
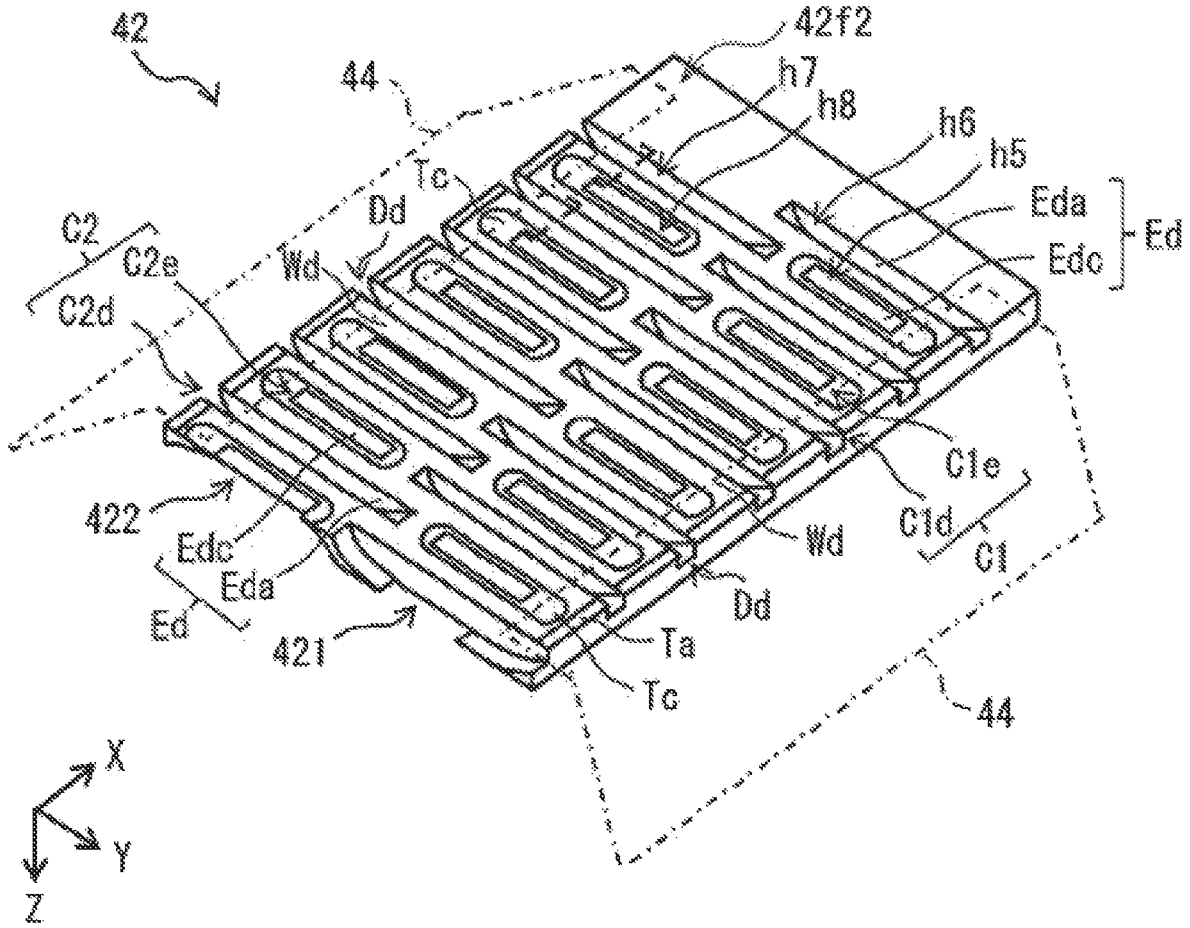
FIG. 4 is a perspective view showing a configuration example of a reverse surface of the actuator plate shown in FIG. 3.
Figure 5:
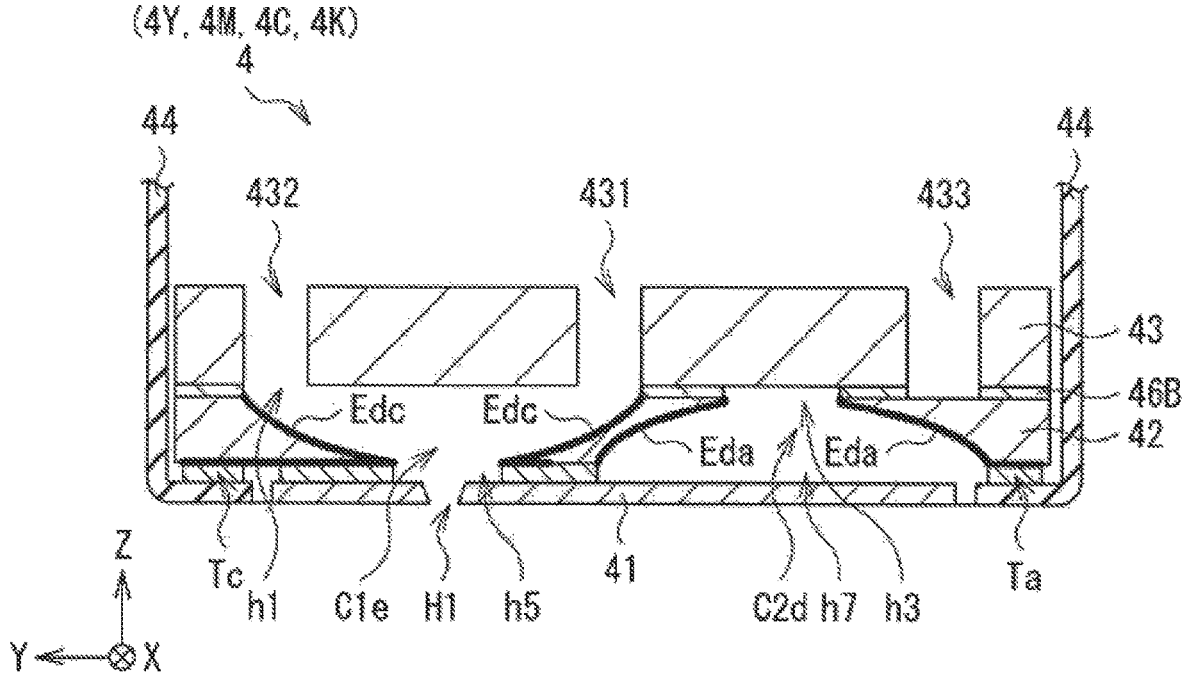
FIG. 5 is a schematic diagram showing a configuration example of the cross-section along the line A-A shown in FIG. 3.
Figure 6:
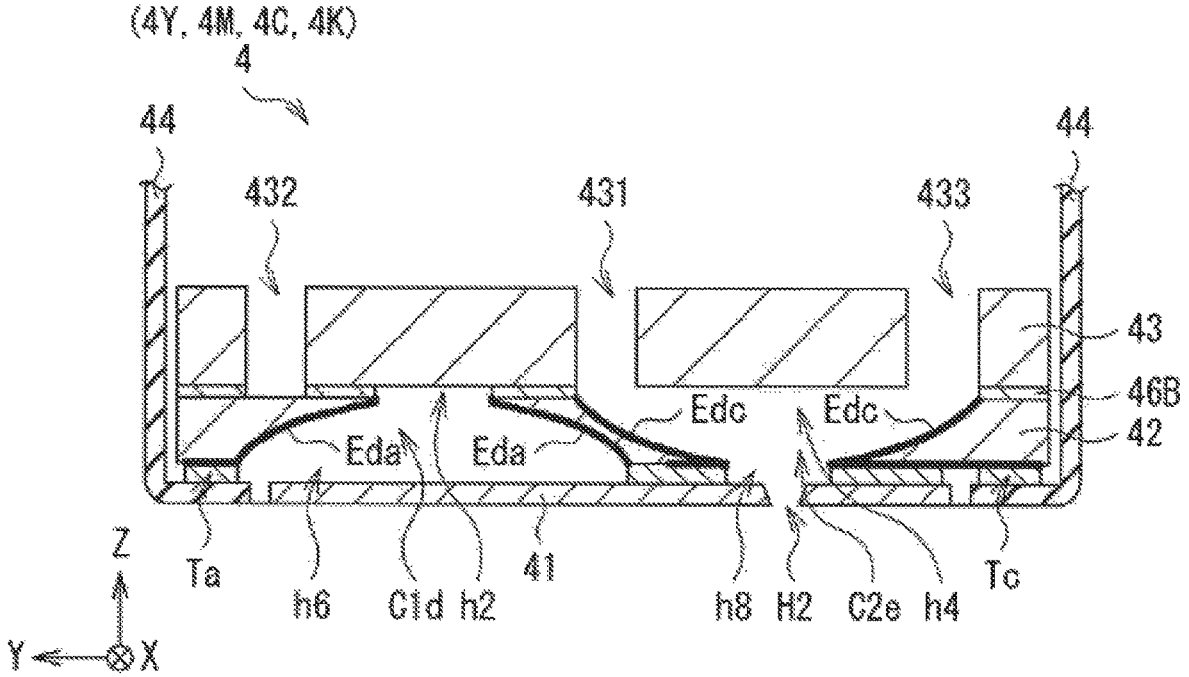
FIG. 6 is a schematic diagram showing a configuration example of the cross-section along the line B-B shown in FIG. 3.
Figure 7:
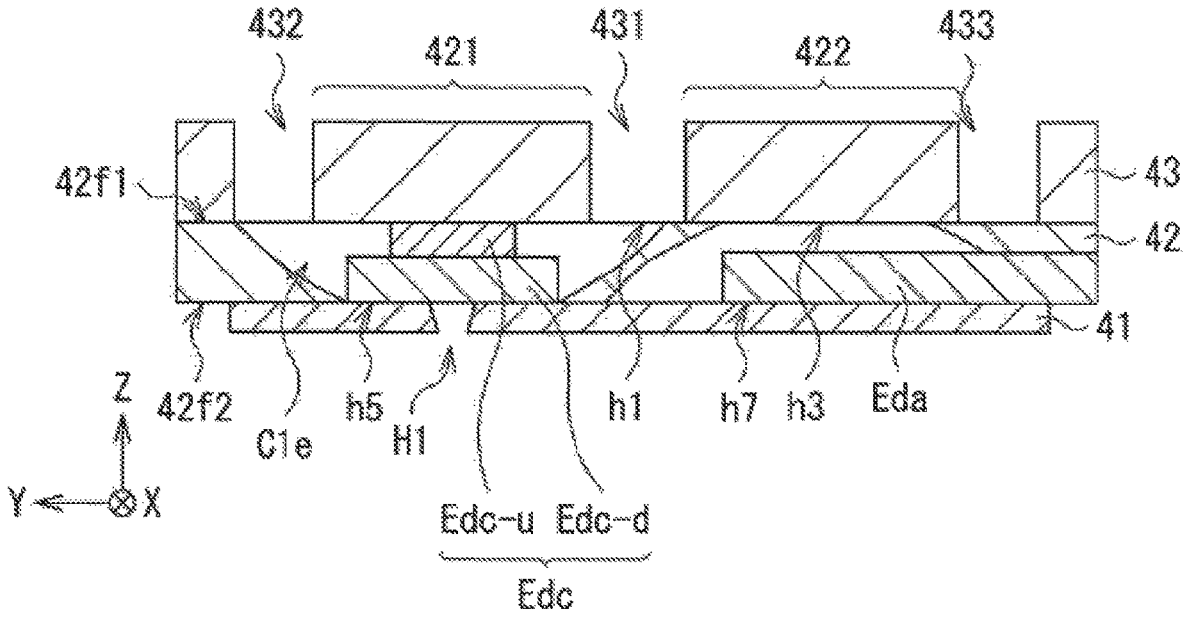
FIG. 7 is a schematic diagram showing an example of a relationship between the ejection channel and the common electrodes shown in FIG. 3.

Then, the detailed configuration example of each of the inkjet heads 4 will be described with reference to FIG. 3 through FIG. 8 in addition to FIG. 1 and FIG. 2. FIG. 3 is an exploded perspective view showing the detailed configuration example of the inkjet head 4. FIG. 4 is a perspective view showing a configuration example of a reverse surface of the actuator plate 42 (described later) shown in FIG. 3. FIG. 5 is a diagram schematically showing a configuration example of the cross-section along the line A-A shown in FIG. 3. FIG. 6 is a diagram schematically showing a configuration example of the cross-section along the line B-B shown in FIG. 3. FIG. 7 is a diagram schematically showing a relationship between each of ejection grooves (ejection channels C1*e* described later) of the actuator plate 42 and an electrode (a common electrode Edc described later) disposed in each of the ejection grooves, FIG. 8 is a diagram schematically showing a configuration example of a part of the cross-section along the line C-C shown in FIG. 3.

The inkjet heads 4 according to the present embodiment are each an inkjet head of a so-called side-shoot type for ejecting the ink 9 from a central part in the extending direction (the Y-axis direction) of each of a plurality of channels (channels C1, C2) described later. Further, the inkjet heads 4 are each an inkjet head of a circulation type which uses the circulation mechanism 5 (the circulation channel 50) described above to thereby use the ink 9 while circulating the ink 9 between the inkjet head 4 and the ink tank 3.

Figure 8:
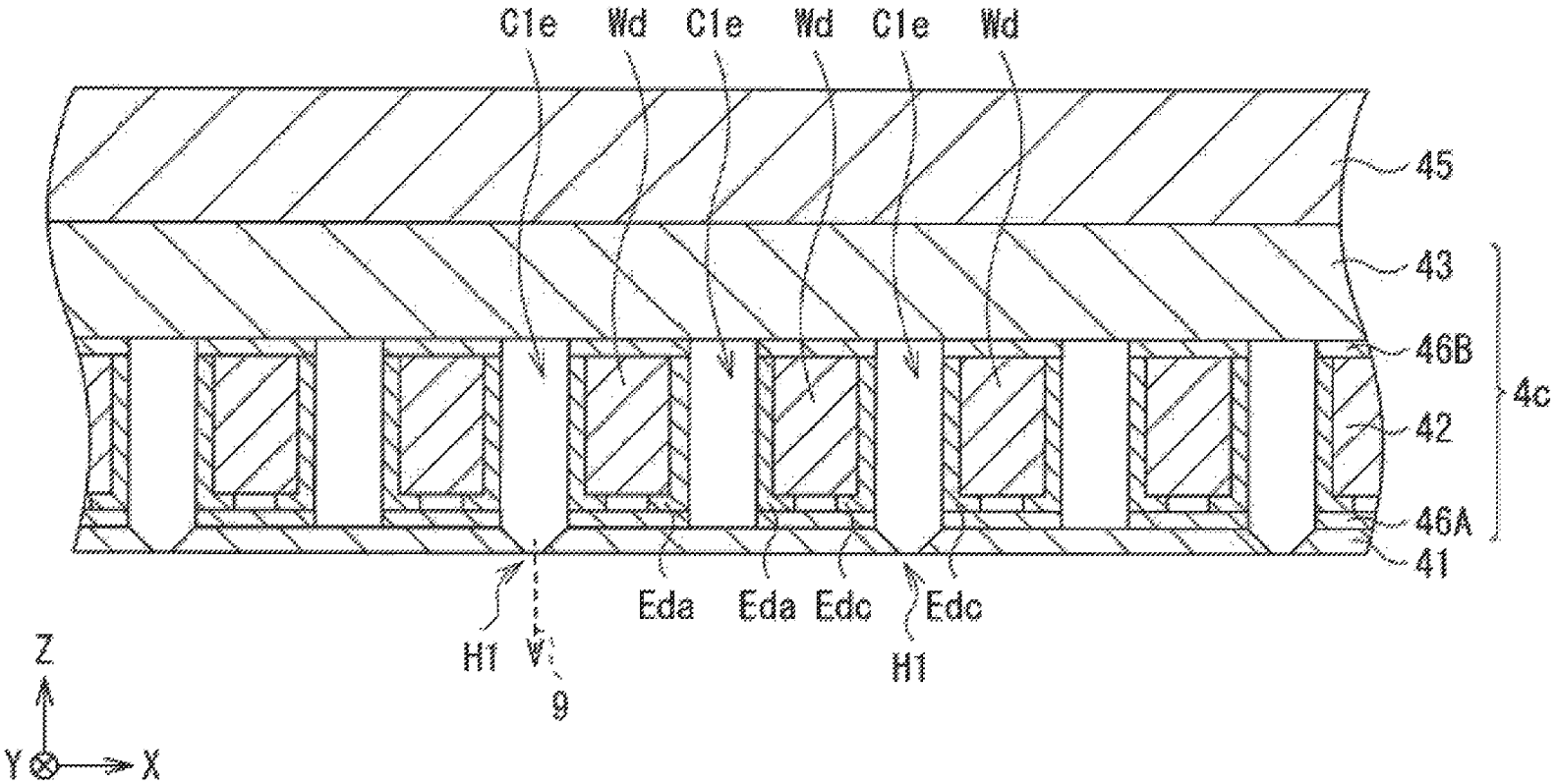
FIG. 8 is a schematic diagram showing a configuration example of a part of the cross-section along the line C-C shown in FIG. 3.

As shown in FIG. 8, the inkjet heads 4 are each provided with a head chip 4*c* and a flow channel plate 45. The head chip 4*c* is mainly provided with a nozzle plate 41, an actuator plate 42, and a cover plate 43. The nozzle plate 41, the actuator plate 42, and the cover plate 43 are bonded to each other using, for example, an adhesive, and are stacked on one another in this order along the Z-axis direction. The flow channel plate 45 is bonded to the cover plate 43. It should be noted that the description will hereinafter be presented with the cover plate 43 side along the Z-axis direction referred to as an upper side, and the nozzle plate 41 side referred to as a lower side. Here, the head chip 4*c* corresponds to a specific example of a "head chip" in the present disclosure, and the "flow channel plate 45" corresponds to a specific example of a "supply mechanism" in the present disclosure.

(Nozzle Plate 41)

The nozzle plate 41 is a plate used in the inkjet head 4. The nozzle plate 41 has a resin substrate or a metal substrate having a thickness of, for example, about 50 μm, and is bonded to a lower surface of the actuator plate 42 as shown in FIG. 3. As a material of the resin substrate used as the nozzle plate 41, there can be cited polyimide and so on. As a material of the metal substrate used as the nozzle plate 41, there can be cited stainless steel such as SUS 316 or SUS 304. The nozzle plate 41 is lower in rigidity compared to, for example, the actuator plate 42. Further, the nozzle plate 41 is flexible compared to, for example, the actuator plate 42. Further, as shown in FIG. 3 and FIG. 4, the nozzle plate 41 has two nozzle columns (nozzle columns 411, 412) each extending along the X-axis direction. These nozzle columns 411, 412 are arranged along the Y-axis direction at a predetermined distance. As described above, the inkjet heads 4 of the present embodiment are each formed as a two-column type inkjet head.

The nozzle column 411 has a plurality of nozzle holes H1 formed in alignment with each other at predetermined intervals along the X-axis direction. These nozzle holes H1 are provided one-to-one to the ejection channels C1*e* described later. These nozzle holes H1 each penetrate the nozzle plate 41 along the thickness direction (the Z-axis direction) of the nozzle plate 41, and are communicated with the respective ejection channels C1*e* in the actuator plate 42 described later as shown in, for example, FIG. 5 and FIG. 6. Specifically, as shown in FIG. 3, each of the nozzle holes H1 is formed so as to be located in a central part along the Y-axis direction below the ejection channel C1*e*. Further, the formation pitch along the X-axis direction in the nozzle holes H1 is arranged to be equal to the formation pitch along the X-axis direction in the ejection channels C1*e*. Although the details will be described later, the ink 9 supplied from the inside of the ejection channel C1*e* is ejected (jetted) from the nozzle hole H1 in such a nozzle column 411.

The nozzle column 412 similarly has a plurality of nozzle holes H2 formed in alignment with each other at predetermined intervals along the X-axis direction. These nozzle holes H2 are provided one-to-one to the ejection channels C2*e* described later. Each of these nozzle holes H2 also penetrates the nozzle plate 41 along the thickness direction of the nozzle plate 41, and is communicated with the ejection channel C2*e* in the actuator plate 42 described later as shown in, for example, FIG. 5 and FIG. 6. Specifically, as shown in FIG. 3, each of the nozzle holes H2 is formed so as to be located in a central part along the Y-axis direction below the ejection channel C2*e*. Further, the formation pitch along the X-axis direction in the nozzle holes H2 is arranged to be equal to the formation pitch along the X-axis direction in the ejection channels C2*e*. Although the details will be described later, the ink 9 supplied from the inside of the ejection channel C2*e* is ejected (jetted) also from the nozzle hole H2 in such a nozzle column 412.

(Actuator Plate 42)

The actuator plate 42 is a plate formed of a piezoelectric material such as lead zirconate titanate (PZT), and has an obverse surface 42/1 and a reverse surface 42/2. The obverse surface 42/1 is an opposed surface to the cover plate 43, and the reverse surface 42/2 is an opposed surface to the nozzle plate 41. The actuator plate 42 is, for example, a so-called chevron type actuator formed by stacking two piezoelectric substrates different in polarization direction in the thickness direction (the Z-axis direction) on one another. It should be noted that it is also possible for the actuator plate 42 to be a so-called cantilever type (a monopole type) actuator formed of a single piezoelectric substrate having the polarization direction set to one direction along the thickness direction (the Z-axis direction). Further, as shown in FIG. 3 and FIG. 4, the actuator plate 42 has two channel columns (channel columns 421, 422) each extending along the X-axis direction. These channel columns 421, 422 are arranged along the Y-axis direction at a predetermined distance.

As shown in FIG. 3 and FIG. 4, the channel column 421 has the plurality of channels C1 each extending along the Y-axis direction. These channels C1 are arranged side by side so as to be parallel to each other at predetermined intervals along the X-axis direction. Each of the channels C1 is defined by drive walls Wd formed of a piezoelectric body (the actuator plate 42), and forms a groove section penetrating the actuator plate 42 in the thickness direction. Here, the Y-axis direction corresponds to a specific example of a "predetermined direction" in the present disclosure, and the drive wall Wd corresponds to a specific example of a "sidewall" in the present disclosure.

As shown in FIG. 3 and FIG. 4, the channel column 422 similarly has the plurality of channels C2 each extending along the Y-axis direction. These channels C2 are arranged side by side so as to be parallel to each other at predetermined intervals along the X-axis direction. Each of the channels C2 is also defined by the drive walls Wd described above, and forms a groove section penetrating the actuator plate 42 in the thickness direction.

Here, as shown in FIG. 3 and FIG. 4, the channels C1 are configured including the ejection channels C1*e* for ejecting the ink 9, and non-ejection channels C1*d* not ejecting the ink 9. In the channel column 421, the ejection channels C1*e* and the non-ejection channels C1*d* are alternately disposed along the X-axis direction. Each of the ejection channels C1*e* is an ejection groove communicated with the nozzle hole H1 in the nozzle plate 41. In other words, each of the ejection channels C1*e* forms the groove section penetrating the actuator plate 42 in the thickness direction. The obverse surface 42/1 of the actuator plate 42 is provided with openings h1 communicated with the respective ejection channels C1*e*, and the reverse surface 42/2 is provided with openings h5 communicated with the respective ejection channels C1*e*.

In contrast, each of the non-ejection channels C1*d* is a non-ejection groove which is not communicated with the nozzle hole H1, and is covered with an upper surface of the nozzle plate 41 from below. For example, each of the non-ejection channels C1*d* forms the groove section penetrating the actuator plate 42. The obverse surface 42/1 of the actuator plate 42 is provided with openings h2 communicated with the respective non-ejection channels C1*d*, and the reverse surface 42/2 is provided with openings h6 communicated with the respective non-ejection channels C1*d*. It is also possible for each of the non-ejection channels C1*d* to form a groove section which does not penetrate the actuator plate 42.

Similarly, the channels C2 are configured including the ejection channels C2*e* for ejecting the ink 9, and non-ejection channels C2*d* not ejecting the ink 9. In the channel column 422, the ejection channels C2*e* and the non-ejection channels C2*d* are alternately disposed along the X-axis direction. Each of the ejection channels C2*e* is an ejection groove communicated with the nozzle hole H2 in the nozzle plate 41. In other words, each of the ejection channels C2*e* forms the groove section penetrating the actuator plate 42 in the thickness direction. The obverse surface 42/1 of the actuator plate 42 is provided with openings h1 communicated with the respective ejection channels C2*e*, and the reverse surface 42/2 is provided with openings h8 communicated with the respective ejection channels C2*e*.

In contrast, each of the non-ejection channels C2*d* is a non-ejection groove which is not communicated with the nozzle hole H2, and is covered with an upper surface of the nozzle plate 41 from below. For example, each of the non-ejection channels C2*d* forms the groove section penetrating the actuator plate 42. The obverse surface 42/1 of the actuator plate 42 is provided with openings h3 communicated with the respective non-ejection channels C2*d*, and the reverse surface 42/2 is provided with openings h7 communicated with the respective non-ejection channels C2*d*. It is also possible for each of the non-ejection channels C2*d* to form a groove section which does not penetrate the actuator plate 42.

Here, the ejection channels C1*e*, C2*e* each correspond to a specific example of a "channel" in the present disclosure.

As shown in FIG. 3 and FIG. 4, the ejection channels C1*e* and the non-ejection channels C1*d* in the channels C1, and the ejection channels C2*e* and the non-ejection channels C2*d* in the channels C2 are arranged in a staggered manner. Therefore, in each of the inkjet heads 4 according to the present embodiment, the ejection channels C1*e* in the channels C1 and the ejection channels C2*e* in the channels C2 are arranged in a zigzag manner. As shown in FIG. 3 and FIG. 4, in the actuator plate 42, in the park corresponding to each of the non-ejection channels C1*d*, C2*d*, there is formed a shallow groove section Dd communicated with an outside end part extending along the Y-axis direction in the non-ejection channel C1*d*, C2*d*.

As described later, each of the ejection channels C1*e*, C2*e* and each of the non-ejection channels C1*d*, C2*d* are formed by cutting the piezoelectric substrate using, for example, a dicing blade (also referred to as a diamond blade) obtained by embedding cutting abrasive grains made of diamond or the like on the outer circumference of a disk. Each of the ejection channels C1*e*, C2*e* is formed by cutting the piezoelectric substrate from an upper surface (a surface corresponding to the upper side in the actuator plate 42) toward a lower surface (a surface corresponding to the lower side in the actuator plate 42) using, for example, the dicing blade. Each of the non-ejection channels C1*d*, C2*d* is formed by cutting the piezoelectric substrate from the lower surface toward the upper surface using, for example, the dicing blade.

On this occasion, the cross-sectional shape in the longitudinal direction of each of the ejection channels C1*e*, C2*e* is an inverted trapezoidal shape as shown in, for example, FIG. 5 and FIG. 6. In contrast, the cross-sectional shape in the longitudinal direction of each of the non-ejection channels C1*d*, C2*d* is a trapezoidal shape as shown in, for example, FIG. 5 and FIG. 6.

In the extending direction (the Y-axis direction) of each of the ejection channels C1*e*, the length of the opening h5 in the reverse surface 42/2 of the actuator plate 42 is made shorter than the length of the opening h1 in the obverse surface 42*f*1 of the actuator plate 42 of each of the ejection channels C1*e* as shown in, for example, FIG. 3, FIG. 4, and FIG. 5.

In the extending direction (the Y-axis direction) of each of the ejection channels C2*e*, the length of the opening h8 in the reverse surface 42*f*2 of the actuator plate 42 is made shorter than the length of the opening h4 in the obverse surface 42*f*1 of the actuator plate 42 of each of the ejection channels C2*e* as shown in, for example, FIG. 3, FIG. 4, and FIG. 6.

Here, the openings h1, h4 each correspond to a specific example of a "first opening" in the present disclosure, and the openings h5, h8 each correspond to a specific example of a "second opening" in the present disclosure.

In the extending direction (the Y-axis direction) of each of the non-ejection channels C1*d*, the length of the opening h6 in the reverse surface 42*f*2 of the actuator plate 42 is made longer than the length of the opening h2 in the obverse surface 42*f*1 of the actuator plate 42 of each of the non-ejection channels C1*d* as shown in, for example, FIG. 3, FIG. 4, and FIG. 6.

In the extending direction (the Y-axis direction) of each of the non-ejection channels C2*d*, the length of the opening h7 in the reverse surface 42*f*2 of the actuator plate 42 is made longer than the length of the opening h3 in the obverse surface 42*f*1 of the actuator plate 42 of each of the non-ejection channels C2*d* as shown in, for example, FIG. 3, FIG. 4, and FIG. 5.

The ejection channels C1*e* of the channel column 421 and the non-ejection channels C2*d* of the channel column 422 are respectively arranged along the Y-axis direction as shown in, for example, FIG. 3, FIG. 4 and FIG. 5. In this case, a part of a tilted surface on the non-ejection channel C2*d* side out of the pair of tilted surfaces opposed to each other in the longitudinal direction in the ejection channel C1*e*, and a part of a tilted surface on the ejection channel C1*e* side out of the pair of tilted surfaces opposed to each other in the longitudinal direction in the non-ejection channel C2*d* overlap each other when viewed from the thickness direction (the Z-axis direction) of the actuator plate 42. Thus, it is possible to decrease the distance between the ejection channel C1*e* and the non-ejection channel C2*d* while preventing the ejection channel C1*e* and the non-ejection channel C2*d* from being communicated with each other.

Further, the non-ejection channels C1*d* of the channel column 421 and the ejection channels C2*e* of the channel column 422 are respectively arranged along the Y-axis direction as shown in, for example, FIG. 3, FIG. 4 and FIG. 6. In this case, a part of a tilted surface on the ejection channel C2*e* side out of the pair of tilted surfaces opposed to each other in the longitudinal direction in the non-ejection channel C1*d*, and a part of a tilted surface on the non-ejection channel C1*d* side out of the pair of tilted surfaces opposed to each other in the longitudinal direction in the ejection channel C2*e* overlap each other when viewed from the normal direction (the Z-axis direction) of the actuator plate 42. Thus, it is possible to decrease the distance between the non-ejection channel C1*d* and the ejection channel C2*e* while preventing the non-ejection channel C1*d* and the ejection channel C2*e* from being communicated with each other.

Here, as shown in FIG. 3 through FIG. 8, drive electrodes Ed extending along the Y-axis direction are disposed on the inner side surfaces opposed to each other in each of the drive walls Wd described above. As the drive electrodes Ed, there exist common electrodes Edc disposed on the inner side surfaces facing the ejection channels C1*e*, C2*e*, and active electrodes Eda disposed on the inner side surfaces facing the non-ejection channels C1*d*, C2*d*. Such drive electrodes Ed (the common electrodes Edc and the active electrodes Eda) are each formed up to the same depth (the same depth in the Z-axis direction) as the drive wall Wd on the inner side surface of the drive wall Wd as shown in, for example, FIG. 8. The drive electrodes Ed are not necessarily required to be formed up to the same depth as the drive walls Wd in the inner side surfaces of the channels. Here, the common electrode Edc corresponds to a specific example of an "electrode" in the present disclosure. The drive electrodes Ed are each formed of a laminated film including, for example, titanium (Ti) and gold (Au) in this order from the drive wall Wd side.

As shown in FIG. 7, the common electrodes Edc each include an obverse surface side part Edc-u and a reverse surface side part Edc-d. Both of the obverse surface side part Edc-u and the reverse surface side part Edc-d extend along the Y-axis direction. The obverse surface side part Edc-u is disposed on the drive wall Wd on the opening h1 (or the opening h4) side of the obverse surface 42*f*1, and the reverse surface side part Edc-d is disposed closer to the opening h5 (or the opening h8) of the reverse surface 42*f*2 than the obverse surface side part Edc-u. In the present embodiment, in the extending direction (the Y-axis direction) of the channels C1, C2, the size of the reverse surface side part Edc-d is made equal to the size of the obverse surface side part Edc-u, or larger than the size of the obverse surface side part Edc-u. In other words, the size in the Y-axis direction of the obverse surface side part Edc-u is equal to or smaller than the size in the Y-axis direction of the reverse surface side part Edc-d. Although the details will be described later, thus, the electrode area of the common electrode Edc decreases compared to the case (FIG. 13 described later) of making the size of the obverse surface side part Edc-u larger than the size of the reverse surface side part Edc-d, and it becomes possible to suppress the stray capacitance.

For example, as shown in FIG. 7, the size in the Y-axis direction of the reverse surface side part Edc-d is made larger than the size in the Y-axis direction of the obverse surface side part Edc-u. It is preferable for the size in the Y-axis direction of the reverse surface side part Edc-d to be equal to the size in the Y-axis direction of the opening h5 (or the opening h8). The size in the Y-axis direction of the obverse surface side part Edc-u is made smaller than the size in the Y-axis direction of, for example, the opening h5 (or the opening h7). The reverse surface side part Edc-d is disposed so as to increase in width from the both ends in the Y-axis direction of the obverse surface side part Edc-u. Although not shown in the drawings, as described above, it is possible for the size in the Y-axis direction of the reverse surface side part Edc-d and the size in the Y-axis direction of the obverse surface side part Edc-u to be equal to each other. As described later, by making the size in the Y-axis direction of the obverse surface side part Edc-u equal to or smaller than the size of the opening h5 (or the opening h8) on the nozzle hole H1 (or the nozzle hole H2) side, the stray capacitance is reduced, and it becomes possible to suppress the variation in ejection speed caused by noise.

The inkjet heads 4 each have a bonding layer 46A for fixing the nozzle plate 41 and the actuator plate 42 to each other between the nozzle plate 41 and the actuator plate 42. The bonding layer 46A is formed of an adhesive. In the case in which the nozzle plate 41 is formed of metal, the bonding layer 46A prevents the electrical short circuit between the drive electrodes Ed and the nozzle plate 41. Further, the inkjet heads 4 each have a bonding layer 46B for fixing the actuator plate 42 and the cover plate 43 to each other between the actuator plate 42 and the cover plate 43. The bonding layer 46B is formed of an adhesive. In the case in which the cover plate 43 is formed of metal, the bonding layer 46B prevents the electrical short circuit between the drive electrodes Ed and the cover plate 43. It should be noted that in the case in which the cantilever type described above is used as the actuator plate 42, each of the drive electrodes Ed (the common electrodes Edc and the active electrodes Eda) is not formed beyond an intermediate position in the depth direction (the Z-axis direction) in the inner side surface of the drive wall Wd.

The pair of common electrodes Edc opposed to each other in the same ejection channel C1*e* (or the same ejection channel C2*e*) are electrically connected to each other in a common terminal Tc. Further, the pair of active electrodes Eda opposed to each other in the same non-rejection channel C1*d* (or the same non-ejection channel C2*d*) are electrically separated from each other. In contrast, the pair of active electrodes Eda opposed to each other via the ejection channel C1*e* (or the ejection channel C2*e*) are electrically connected to each other in an active terminal Ta.

Here, on each of an end edge adjacent to the channel column 421 and an end edge adjacent to the channel column 422 in the actuator plate 42, there is mounted a flexible printed circuit board 44 for electrically connecting the drive electrodes Ed and a control section (a control section 40 described later in the inkjet head 4) to each other. Interconnection patterns (not shown) provided to the flexible printed circuit boards 44 are electrically connected to the common terminals Tc and the active terminals Ta described above, Thus, it is arranged that the drive voltage is applied to each of the drive electrodes Ed from the control circuit 40 described later via the flexible printed circuit board 44.

(Cover Plate 43)

As shown in FIG. 3, the cover plate 43 is disposed so as to close the channels C1, C2 (the channel columns 421, 422) in the actuator plate 42. Specifically, the cover plate 43 is fixed to the upper surface of the actuator plate 42 via the bonding layer 46B, and is provided with a plate-like structure.

As shown in FIG. 3, the cover plate 43 is provided with an exit side common ink chamber 431 and a pair of entrance side common ink chambers 432, 433. Specifically, the exit side common ink chamber 431 is formed in an area corresponding to the channel column 421 (the plurality of channels C1) and the channel column 422 (the plurality of channels C2) in the actuator plate 42. The entrance side common ink chamber 432 is formed in an area corresponding to the channel column 421 (the plurality of channels C1) in the actuator plate 42. The entrance side common ink chamber 433 is formed in an area corresponding to the channel column 422 (the plurality of channels C2) in the actuator plate 42.

The exit side common ink chamber 431 is formed in the vicinity of an inner end part along the Y-axis direction in each of the channels C1, C2, and forms a groove section having a recessed shape. To the exit side common ink chamber 431, there is coupled a discharge side flow channel (not shown) of the flow channel plate 45, and the ink 9 is discharged via the discharge side flow channel of the flow channel plate 45. In areas corresponding respectively to the ejection channels C1*e*, C2*e* in the exit side common ink chamber 431, there are respectively formed discharge slits (not shown) penetrating the cover plate 43 along the thickness direction of the cover plate 43.

As shown in FIG. 3, the entrance side common ink chamber 432 is formed in the vicinity of an outer end part along the Y-axis direction in each of the channels C1, and forms a groove section having a recessed shape. To the entrance side common ink chamber 432, there is coupled a supply side flow channel (not shown) of the flow channel plate 45, and the ink 9 flows into the entrance side common ink chamber 432 via the supply side flow channel of the flow channel plate 45. Similarly, the entrance side common ink chamber 433 is formed in the vicinity of an outer end part along the Y-axis direction in each of the channels C2, and forms a groove section having a recessed shape. To the entrance side common ink chamber 433, there is coupled the supply side flow channel (not shown) of the flow channel plate 45, and the ink 9 flows into the entrance side common ink chamber 433 via the supply side flow channel of the flow channel plate 45.

In such a manner, the exit side common ink chamber 431 and the entrance side common ink chambers 432, 433 are each communicated with the ejection channels C1*e*, C2*e* via the supply slits and the discharge slits, respectively, on the one hand, but are not communicated with the non-ejection channels C1*d*, C2*d* on the other hand. Specifically, the non-ejection channels C1*d*, C2*d* are closed by bottom parts of the exit side common ink chamber 431 and the entrance side common ink chambers 432, 433.

(Flow Channel Plate 45)

As shown in FIG. 8, the flow channel plate 45 is disposed on the upper surface of the cover plate 43, and has a predetermined flow channel (the supply side flow channel and the discharge side flow channel described above) through which the ink 9 flows. Further, to the flow channel in such a flow channel plate 45, there are connected the flow channels in the circulation mechanism 5 described above so as to achieve inflow of the ink 9 to the flow channel and outflow of the ink 9 from the flow channel, respectively. It should be noted that since it is arranged that the dummy channels C1*d*, C2*d* are closed by the bottom part of the cover plate 43 as described above, the ink 9 is supplied only to the ejection channels C1*e*, C2*e*, but does not inflow into the dummy channels C1*d*, C2*d*.

(Control Section 40)

Here, each of the inkjet heads 4 according to the present embodiment is also provided with the control section 40 for performing control of a variety of operations in the printer 1 as shown in FIG. 2. The control section 40 is arranged to control, for example, a variety of operations in the liquid feeding pumps 52*a*, 52*b* described above and so on besides a recording operation (the jet operation of the ink 9 in the inkjet head 4) of images, characters and so on in the printer 1. Such a control section 40 is formed of, for example, a microcomputer having an arithmetic processing section and a storage section formed of a variety of types of memory.

[Method of Manufacturing Inkjet Head 4]

Figure 9A:
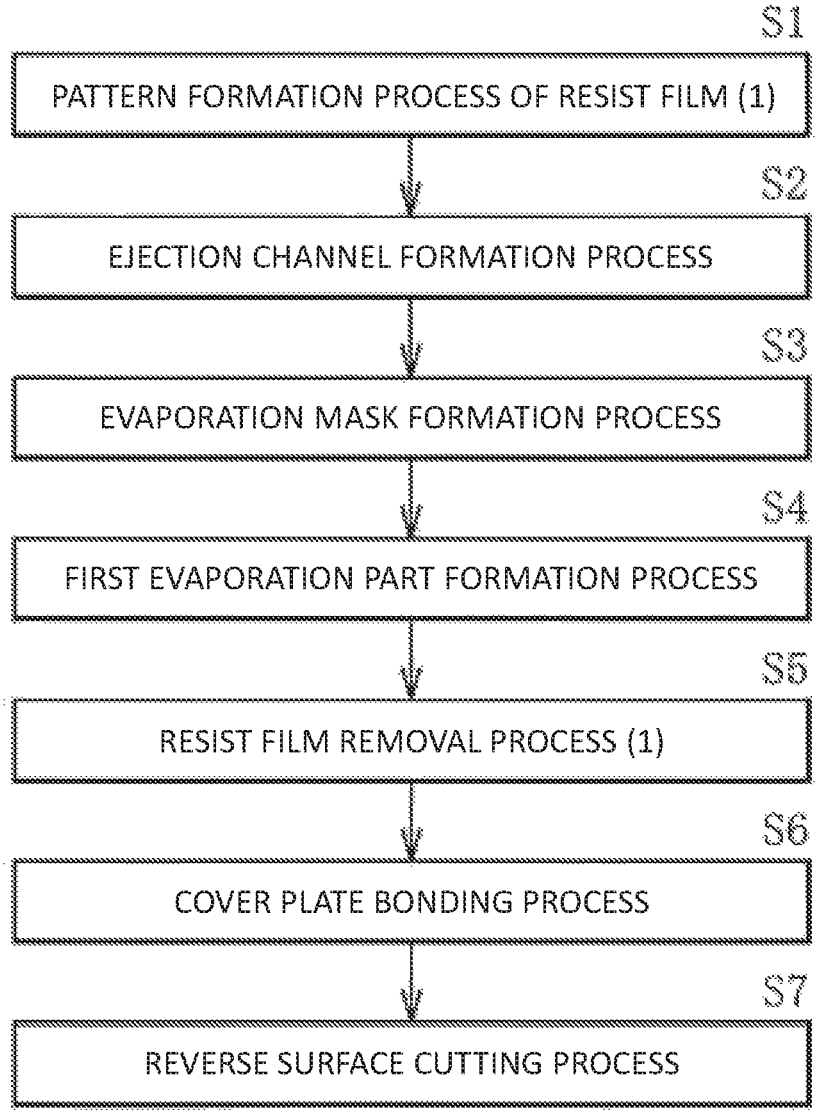
Figure 9B:
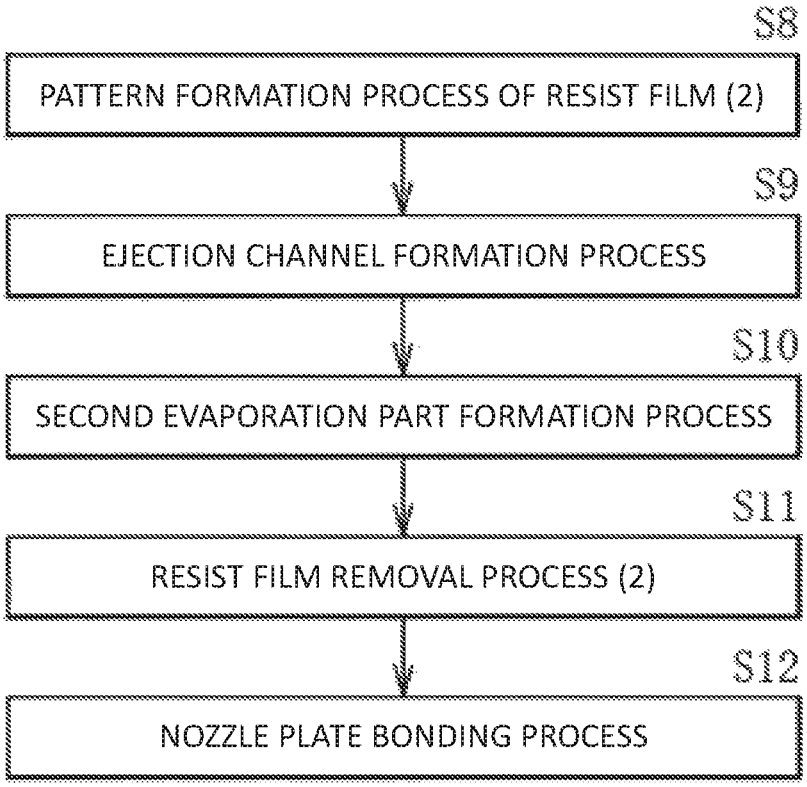
FIG. 9B is a flow chart showing a process following the process shown in FIG. 9A.

Then, a method of manufacturing the inkjet head 4 will be described using FIG. 9A through FIG. 11B. FIG. 9A and FIG. 9B are flow charts showing an example of the method of manufacturing the inkjet head 4, and FIG. 10A through FIG. 10H are schematic cross-sectional views for explaining the respective processes shown in FIG. 9A and FIG. 9B. The cross-sectional views shown in FIG. 10A through FIG. 10H correspond to cross-sectional views (see FIG. 8) along the line C-C shown in FIG. 3. FIG. 11A is a schematic plan view showing an evaporation mask formation process of the step S3 shown in FIG. 9A, and FIG. 11B is a schematic cross-sectional view corresponding thereto. Hereinafter, a process of manufacturing the actuator plate 42 will mainly be described.

Firstly, a piezoelectric substrate 42Z for constituting the actuator plate 42 is prepared, and a pattern RP1 of a resist film is formed (step S1 in FIG. 9A) on an obverse surface (a surface to form the obverse surface 42*f*1 of the actuator plate 42) of the piezoelectric substrate 42Z. Then, the ejection channels C1*e*, C2*e* are provided (step S2 in FIG. 9A) to the piezoelectric substrate 42Z. Hereinafter, the steps S1, S2 will be described using FIG. 10A and FIG. 10B.

Figure 10A:
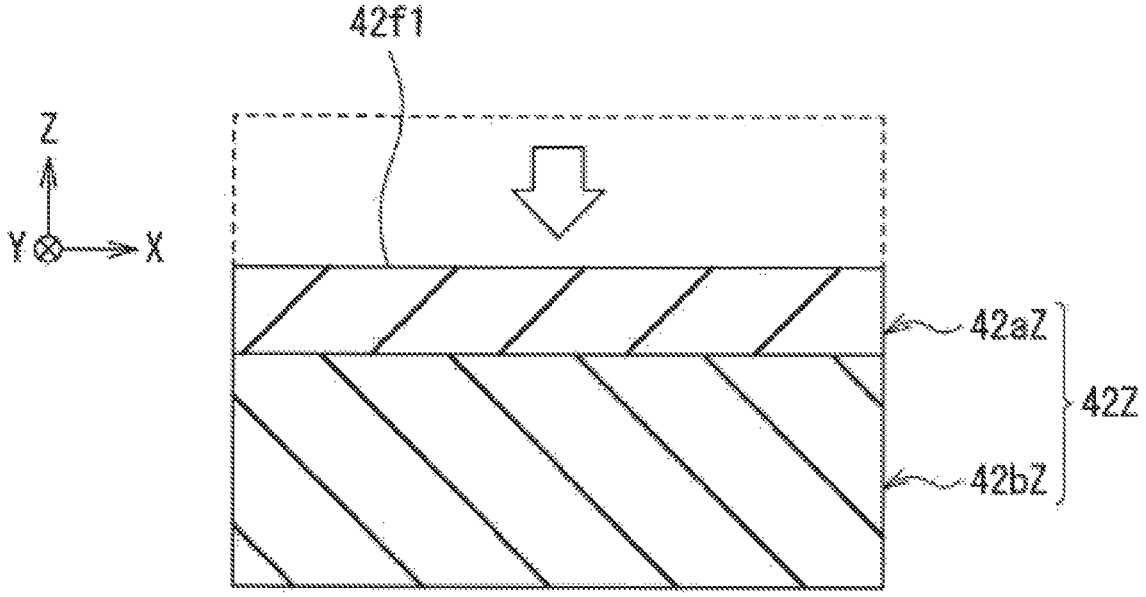
FIG. 10A is a schematic cross-sectional view for explaining one process of a method of manufacturing the liquid jet head shown in FIG. 9A.
Figure 11A:
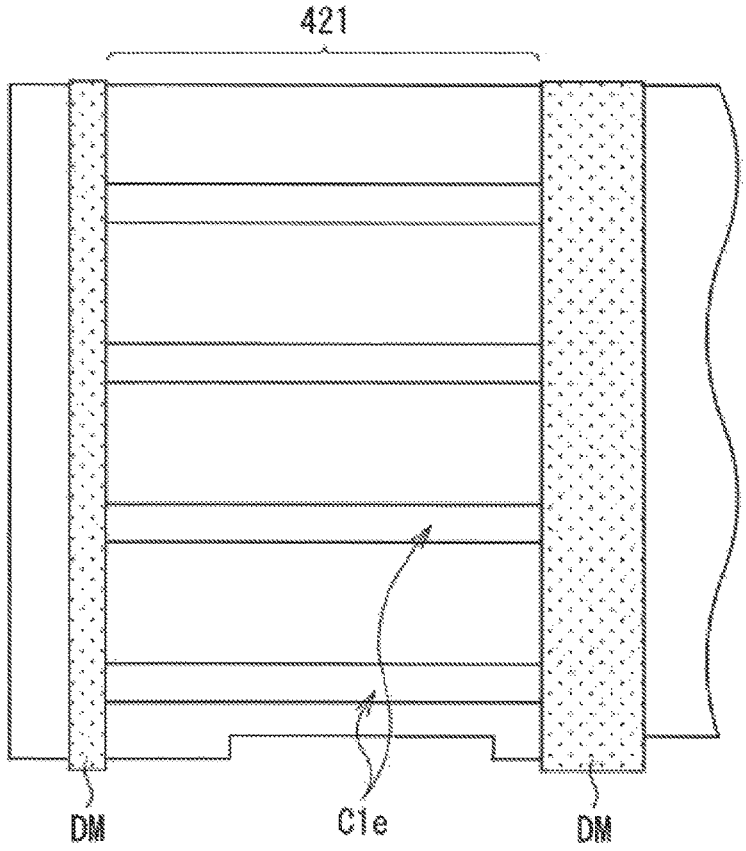
FIG. 11A is a schematic plan view for explaining the process of the step S5 shown in FIG. 9A.
Figure 11B:
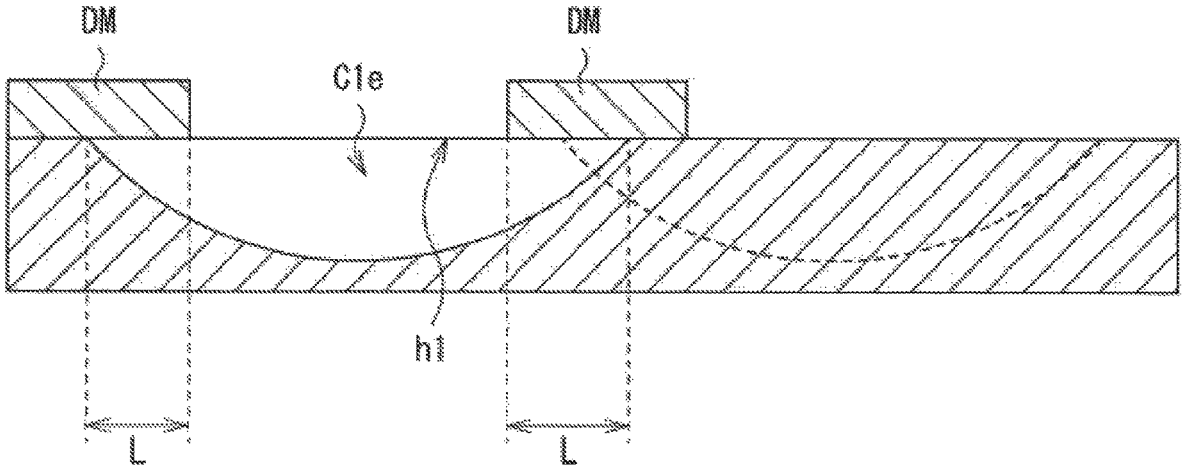
FIG. 11B is a schematic cross-sectional view corresponding to FIG. 11A.

FIG. 10A shows a preparation process of the piezoelectric substrate 42Z. Firstly, two piezoelectric wafers (a piezoelectric wafer 42*a*Z and a piezoelectric wafer 42*b*Z) on which the polarization treatment has been performed in the thickness direction (the Z-axis direction) are prepared, and are stacked on one another so that the polarization directions thereof become opposite to each other. Subsequently, grinding work is performed on the piezoelectric wafer 42*a*Z as needed to adjust the thickness of the piezoelectric wafer 42*a*Z. The obverse surface of the piezoelectric wafer 42*a*Z on this occasion becomes the obverse surface 42*f*1. Thus, the piezoelectric substrate 42Z is formed.

Figure 10B:
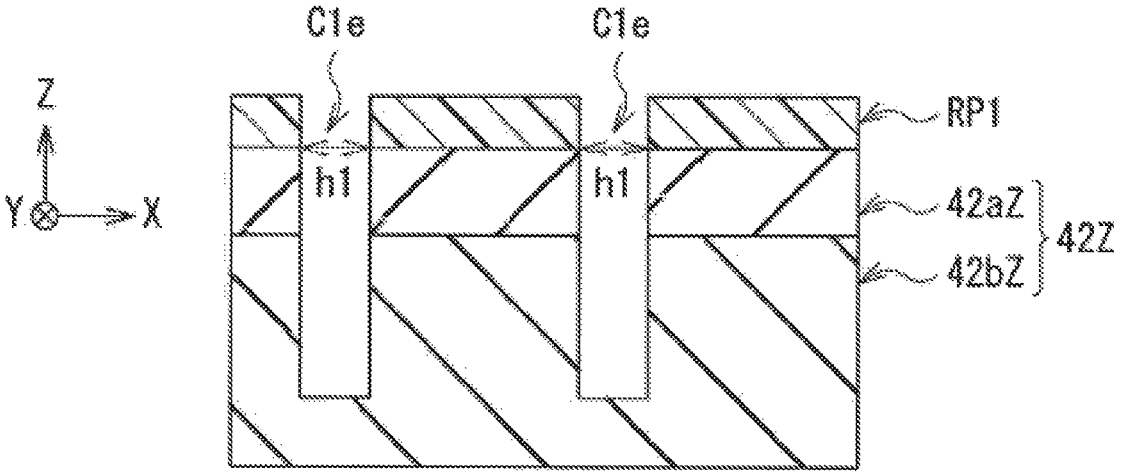
FIG. 10B is a schematic cross-sectional view showing a process following the process shown in FIG. 10A.

Then, the pattern RP1 of the resist film is formed on the obverse surface of the piezoelectric substrate 42Z, and then, the ejection channels C1*e*, C2*e* are formed (FIG. 10B). The pattern RP1 of the resist film functions as a mask when forming the common electrodes Edc and so on, and is formed on the obverse surface of the piezoelectric substrate 42Z described above. It is also possible for the pattern RP1 of the resist film to have a plurality of openings corresponding to the plurality of ejection channels C1*e*, C2*e* at predetermined positions where the plurality of ejection channels C1*e*, C2*e* is to be formed. It should be noted that the pattern RP1 of the resist film can be formed of dry resist, or can also be formed of wet resist.

The ejection channels C1*e*, C2*e* are formed by performing cutting work from the obverse surface of the piezoelectric substrate 42Z using a dicing blade or the like not shown. Specifically, by digging down an exposed part which is not covered with the pattern RP1 of the resist film out of the piezoelectric substrate 42Z, the plurality of ejection channels C1*e* and the plurality of ejection channels C2*e* are formed so as to be arranged in parallel to each other at intervals in the X-axis direction, and at the same time arranged alternately. The obverse surface of the piezoelectric substrate 42Z is provided with the openings h1 (or the openings h4).

After forming the ejection channels C1*e*, C2*e*, in the present embodiment, an evaporation mask DM is formed (step S3 in FIG. 9A) on the obverse surface of the piezoelectric substrate 42Z as shown in FIG. 11A and FIG. 11B. The evaporation mask DM is for selectively covering the both end parts in the extending direction (the Y-axis direction) of the ejection channels C1*e*, C2*e* (the openings h1, h4). By forming such an evaporation mask DM in advance, a first evaporation part Edc-1 is not formed in each of the both end parts in the Y-axis direction of the ejection channel C1*e* in the subsequent formation process (step S4 in FIG. 9A) of the first evaporation part Edc-1. Therefore, in the common electrode Edc, the size in the Y-axis direction of the obverse surface side part Edc-u on the opening h1, h4 side becomes smaller than the size in the Y-axis direction of the reverse surface side part Edc-d (see FIG. 7).

The evaporation mask DM is formed of a metal material such as SUS (Stainless Used Steel). The size of an area L in each of the both end parts of each of the ejection channels C1*e*, C2*e* covered with the evaporation mask DM will be described later.

After forming the evaporation mask DM on the obverse surface of the piezoelectric substrate 42Z, the first evaporation part Edc-1 constituting a part of the common electrode Edc is formed (step S4 in FIG. 9A) on the inner side surface of each of the ejection channels C1*e*, C2*e*. Then, the pattern RP1 of the resist film is removed (step S5 in FIG. 9A), Subsequently, the cover plate 43 is bonded (step S6 in FIG. 9A) to the obverse surface of the piezoelectric substrate 42Z. Hereinafter, the steps S4, S5, and S6 will be described using FIG. 10C and FIG. 10D.

Figure 10C:
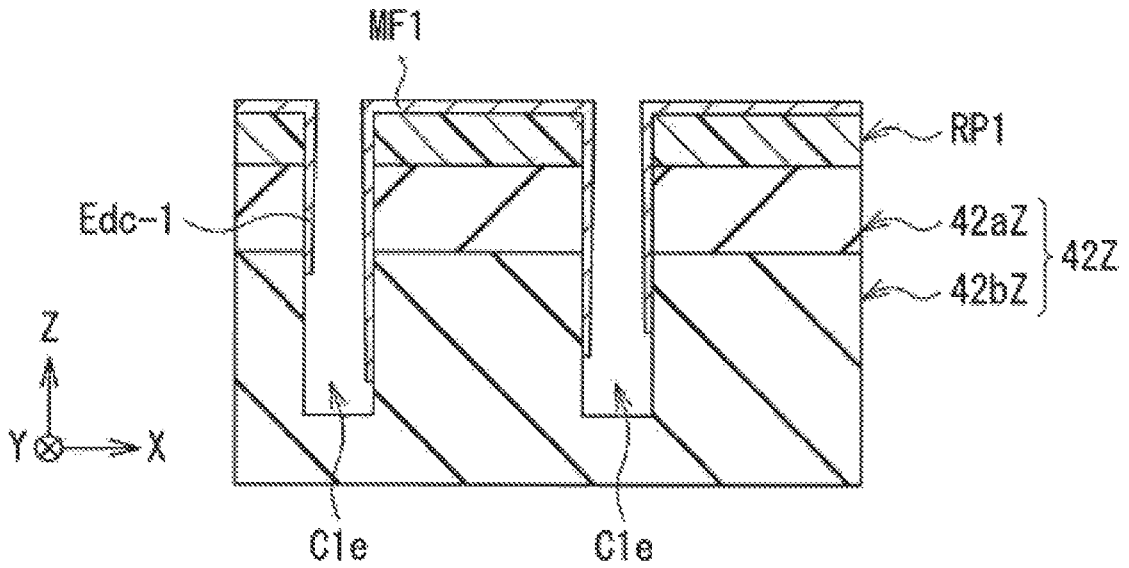
FIG. 10C is a schematic cross-sectional view showing a process following the process shown in FIG. 10B.

As shown in FIG. 10C, the first evaporation part Edc-1 is formed of a metal coating MF1 formed on the inner side surface of each of the ejection channels C1*e*, C2*e*. The metal coating MF1 is formed by evaporating a conductive material on the inner side surfaces of the plurality of ejection channels C1*e*, C2*e* and the resist pattern RP1 from, for example, the opening h1, h4 side (the obverse surface side of the piezoelectric substrate 42Z). On this occasion, by performing oblique vapor deposition for attaching the constituent material of the metal coating MF1 from an oblique direction (e.g., an incident angle β in FIG. 12 described later) to the inner surfaces, the metal coating MF1 (the first evaporation part Edc-1) is formed up to a deep position of the ejection channels C1*e*, C2*e* in the Z-axis direction.

Here, since the both end parts in the Y-axis direction of each of the ejection channels C1*e*, C2*e* are covered with the evaporation mask DM as described above, the first evaporation part Edc-1 is not formed in each of the both end parts in the Y-axis direction on the opening h1, h5 side. The first evaporation part Edc-1 is formed on the inner side in the Y-axis direction of the area L of each of the ejection channels C1*e*, C2*e* covered with the evaporation mask DM. The first evaporation part Edc-1 mainly constitutes the obverse surface side part Edc-u of the common electrode Edc.

It should be noted that it is also possible to perform a descumming treatment for removing residues such as the resist adhering to the inner side surfaces of each of the ejection surfaces C1*e*, C2*e* as needed in an anterior stage to the formation of the metal coating MF1.

Figure 10D:
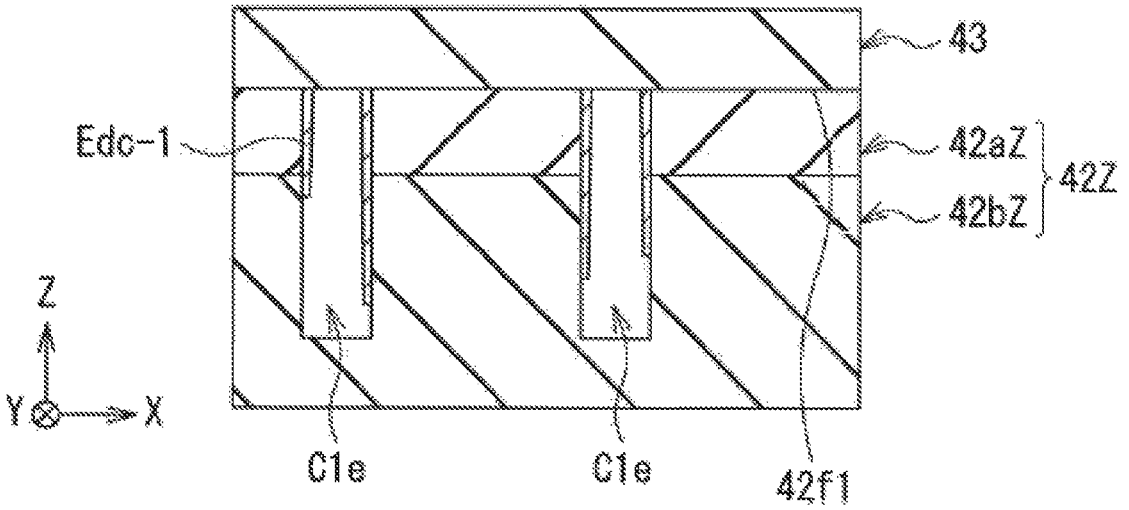
FIG. 10D is a schematic cross-sectional view showing a process following the process shown in FIG. 10C.

After forming the metal coating MF1, as shown in FIG. 10D, the resist pattern RP1 is removed (a liftoff method), and then, the cover plate 43 is bonded to the obverse surface of the piezoelectric substrate 42Z using an adhesive 46B. Here, by removing the resist pattern RP1 only a part (the first evaporation part Edc-1) covering the inner side surface of each of the ejection channels C1*e*, C2*e* out of the metal coating MF1 remains.

In the liftoff method, burrs due to the metal coating MF1 are apt to occur. If such burrs occur frequently, a removal process of the burrs becomes necessary. The burrs due to the metal coating MF1 are apt to occur in the both end parts in the extending direction (the Y-axis direction) of the ejection channels C1*e*, C2*e*. Here, since the first evaporation part Edc-1 is not formed in the both end parts in the Y-axis direction on the opening h1, h5 side as described above, if the first evaporation part Edc-1 is formed using the liftoff method, the burrs due to the liftoff method are difficult to occur. Therefore, it is possible to omit the removal process of the burrs, and it becomes possible to suppress the number of processes.

After bonding the cover plate 43 on the obverse surface of the piezoelectric substrate 42Z, the piezoelectric substrate 42Z is ground (step S7 in FIG. 9A) from the reverse surface side (the piezoelectric wafer 42*b*Z side).

Figure 10E:
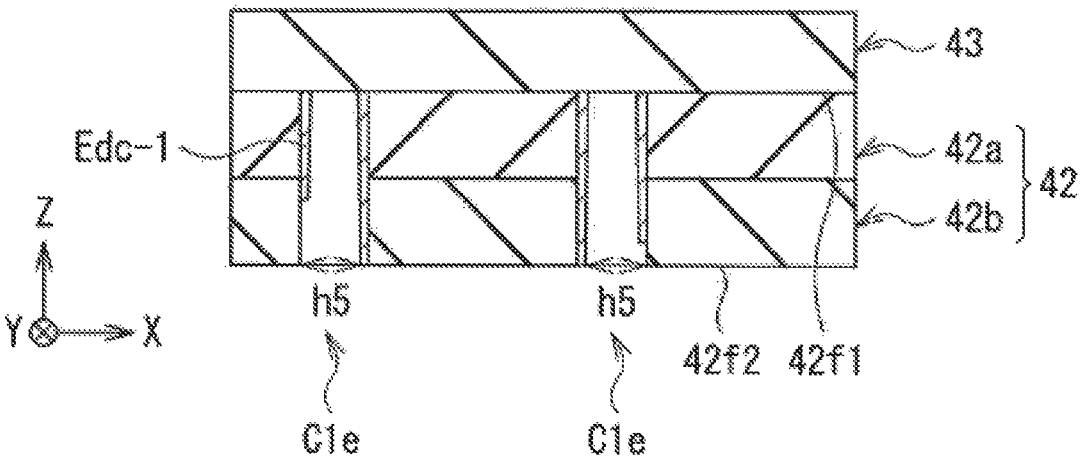
FIG. 10E is a schematic cross-sectional view showing a process following the process shown in FIG. 10D.
Figure 10F:
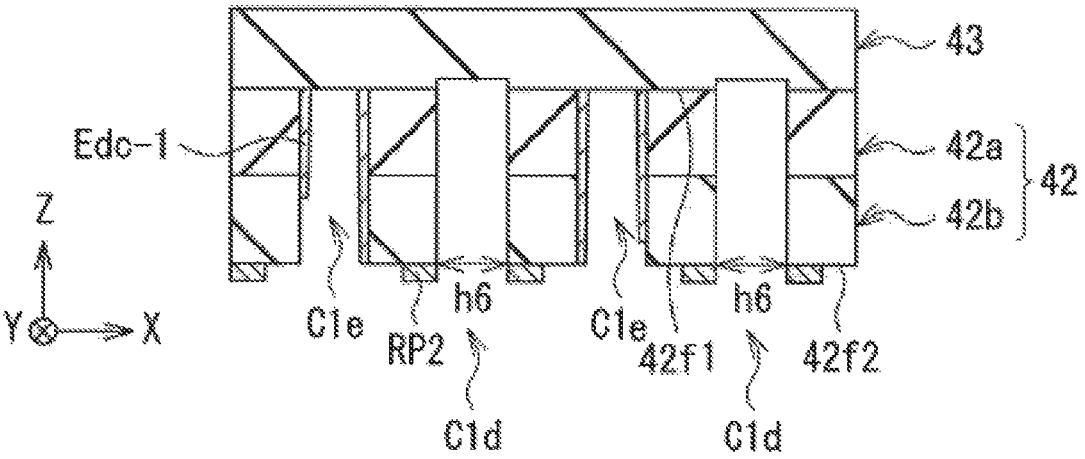
FIG. 10F is a schematic cross-sectional view showing a process following the process shown in FIG. 10E.

FIG. 10E shows a schematic configuration of the step S7. As described above, the grinding work is performed on the piezoelectric wafer 42*b*Z from a reverse surface (a surface on the opposite side to the piezoelectric wafer 42*a*Z) to adjust the thickness of the piezoelectric wafer 42*b*Z. The reverse surface of the piezoelectric wafer 42*b*Z on this occasion becomes the reverse surface 42*f*2. The grinding work is performed until the plurality of ejection channels C1*e*, C2*e* is exposed. Thus, the openings h5 (or the openings h8) of the reverse surface 42*f*2 respectively communicated with the ejection channels C1*e*, C2*e* are formed. Thus, a so-called chevron type actuator plate 42 is formed.

Here, the size of the area L in each of the both end parts of the ejection channels C1*e*, C2*e* covered with the evaporation mask DM will be described.

It is preferable for the evaporation mask DM to cover the both end parts of each of the ejection channels C1*e*, C2*e* so as to include a part where the depth Di of the first evaporation part Edc-1 (step S4) to be formed later becomes larger than the depth D of the ejection channels C1*e*, C2*e*. In other words, in the area L (see FIG. 11B) of the both end parts of each of the ejection channels C1*e*, C2*e* to be covered with the evaporation mask DM, in the case in which the evaporation mask DM is not disposed, the first evaporation part Edc-1 is formed deeper than the ejection channels C1*e*, C2*e*, and the evaporation material is attached to the bottom surfaces of the ejection channels C1*e*, C2*e*. If the evaporation material is attached to the bottom surfaces of the ejection channels C1*e*, C2*e* in the step S4, the evaporation material is ground together with the piezoelectric wafer 42*b*Z when performing the grinding work on the piezoelectric wafer 42*b*Z from the reverse surface in the step S7. Thus, the burrs are formed on the reverse surface 42*f*2 of the actuator plate 42, and the removal process of the burrs becomes necessary.

By covering such an area L with the evaporation mask DM, the first evaporation part Edc-1 is not formed in the area L in the step S4, and therefore, it is possible to prevent the burrs from occurring in the reverse surface 42*f*2 of the actuator plate 42 in the step S7. Therefore, it becomes possible to omit the removal process of the burrs to suppress the number of processes.

As described above, it is preferable for the area L to include the part where the depth Di of the first evaporation part Edc-1 becomes larger than the depth D of the ejection channels C1*e*, C2*e*. The depth Di of the first evaporation part Edc-1 is expressed using, for example, the following formula (1).

$$Di = s/\tan(\beta - \theta) - r \quad (1)$$

where s: the width of the ejection channels C1*e*, C2*e*

β: the incident angle of the evaporation when forming the first evaporation part Edc-1

θ: the tilt angle of the piezoelectric substrate 42Z r: the thickness of the resist film (the pattern RP1)

Figure 12:
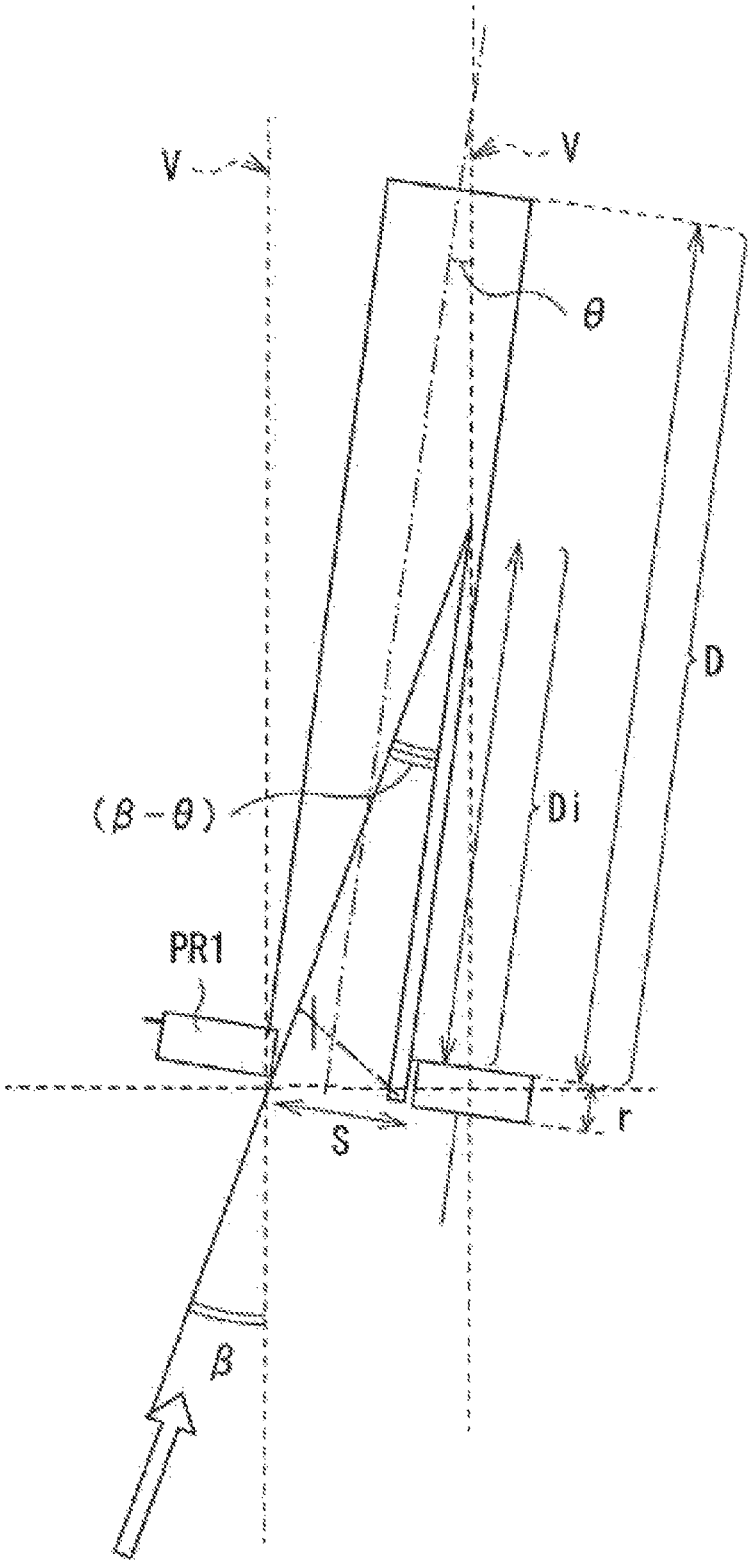
FIG. 12 is a schematic diagram for explaining the area shown in FIG. 11B.

FIG. 12 schematically shows the relationship between the depth D of the ejection channels C1*e*, C2*e* described above, the depth Di of the first evaporation part Edc-1, the width s of the ejection channels C1*e*, C2*e*, the incident angle β, the tilt angle θ, and the thickness r of the resist film (the pattern RP1). The depth D of the ejection channels C1*e*, C2*e* is the size in the Z-axis direction of the ejection channels C1*e*, C2*e*, and the width s of the ejection channels C1*e*, C2*e* is the size in the X-axis direction of the ejection channels C1*e*, C2*e*. The incident angle β is an angle formed by the evaporation direction with respect to the vertical direction V, and the tilt angle θ is an angle formed by the piezoelectric substrate 42Z with respect to the vertical direction V. The thickness r of the resist film (the pattern RP1) is the size in the Z-axis direction of the resist film.

After providing the openings h5 (or the openings h8) of the ejection channels C1*e*, C2*e* to the reverse surface 42*f*2 of the actuator plate 42, a pattern RP2 of a resist film is formed (step S8 in FIG. 9B) on the reverse surface 42*f*2. Then, the non-ejection channels C1*d*, C2*d* are provided (step S9 in FIG. 9B) to the actuator plate 42. Hereinafter, the steps S8, S9 will be described using FIG. 10F.

The pattern RP2 of the resist film to be formed on the reverse surface 42*f*2 of the actuator plate 42 functions as a mask when forming the active electrodes Eda, second evaporation parts Edc-2 described later, and so on. It is also possible for the pattern RP2 of the resist film to have openings corresponding to the plurality of ejection channels C1*e*, C2*e* and the plurality of non-ejection channels C1*d*, C2*d* at predetermined positions at which the plurality of ejection channels C1*e*, C2*e* and the plurality of non-ejection channels C1*d*, C2*d* are to be formed. It should be noted that the pattern RP2 of the resist film can be formed of dry resist, or can also be formed of wet resist.

After forming the pattern RP2 of the resist film on the reverse surface 42*f*2 of the actuator plate 42, the grinding work is performed from the reverse surface 42*f*2 of the actuator plate 42 using a dicing blade or the like not shown. Thus, the non-ejection channels C1*d*, C2*d* are formed. The reverse surface 42*f*2 of the actuator plate 42 is provided with the openings h6 (or the openings h7) of the non-ejection channels C1*d*, C2*d*, and the obverse surface 42*f*1 is provided with the openings h2 (or the openings h3). In the grinding work when forming the non-ejection channels C1*d*, C2*d*, it is also possible to penetrate the actuator plate 42 in the thickness direction, and at the same time, grind a part in the thickness direction of the cover plate 43.

After providing the actuator plate 42 with the plurality of non-ejection channels C1*d*, C2*d*, the active electrodes Eda are formed on the inner side surfaces of each of the non-ejection channels C1*d*, C2*d*, and at the same time, the second evaporation parts Edc-2 are formed on the inner side surfaces of each of the plurality of ejection channels C1*e*, C2*e* (step S10 in FIG. 9B).

Figure 10G:
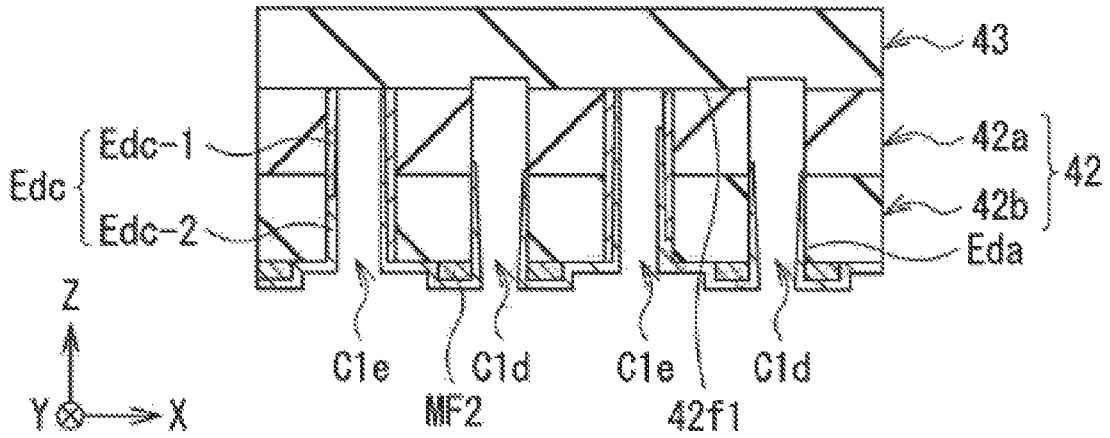
FIG. 10G is a schematic cross-sectional view showing a process following the process shown in FIG. 10F.

FIG. 10G schematically shows a configuration of the step S10. The second evaporation part Edc-2 is formed of a metal coating MF2 formed on the inner side surfaces of each of the ejection channels C1*e*, C2*e*, and the active electrode Eda is formed of the metal coating MF2 formed on the inner side surfaces of each of the non-ejection channels C1*d*, C2*d*. The metal coating MF2 is formed by evaporating a conductive material on the inner side surfaces of the plurality of ejection channels C1*e*, C2*e* and the plurality of non-ejection channels C1*d*, C2*d*, and the resist pattern RP2 from, for example, the opening h5, h6, h7, and h8 side (the reverse surface 42*f*2 side). On this occasion, it is preferable to arrange that the metal coating MF2 (the second evaporation part Edc-2) has contact with the first evaporation part Edc-1, or a part of the metal coating MF2 overlap a part of the first evaporation part Edc-1. The second evaporation part Edc-2 mainly constitutes the reverse surface side part Edc-d of the common electrode Edc. It is also possible for a part of the reverse surface side part Edc-d to be formed of the first evaporation part Edc-1, or it is also possible for a part of the obverse surface side part Edc-u to be formed of the second evaporation part Edc-2. By forming the second evaporation part Edc-2 after forming the first evaporation part Edc-1, the common electrodes Edc are formed on the inner side surfaces of each of the ejection channels C1*e*, C2*e*.

Figure 10H:
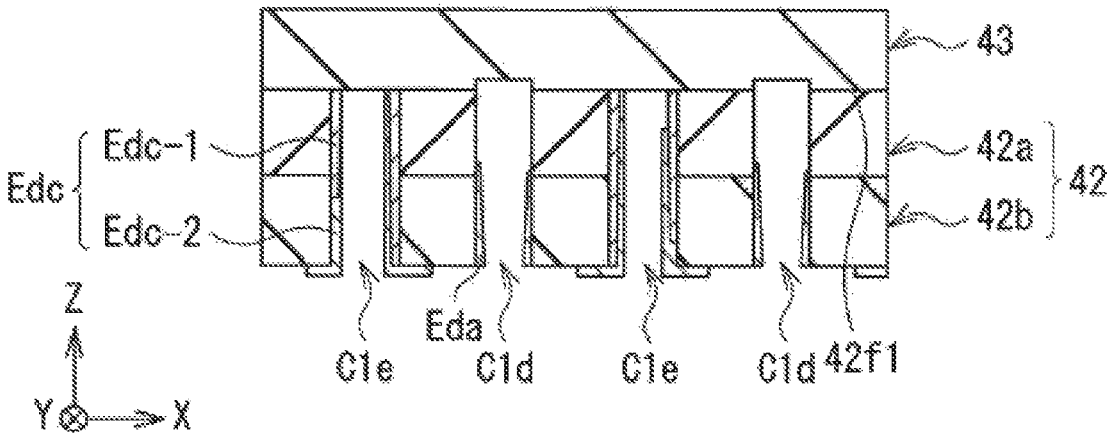
FIG. 10H is a schematic cross-sectional view showing a process following the process shown in FIG. 10G.

After forming the metal coating MF2, the resist pattern RP2 is removed (step S11 in FIG. 9B). By removing the resist pattern RP2 here (the liftoff method), as shown in FIG. 10H, a part (the second evaporation part Edc-2) covering the inner side surfaces of each of the ejection channels C1*e*, C2*e* out of the metal coating MF2 and a part (the active electrode Eda) covering the inner side surfaces of each of the non-ejection channels C1*d*, C2*d* are separated from each other.

As described above, the nozzle plate 41 is bonded to the actuator plate 42 provided with the common electrodes Edc and the active electrodes Eda using the adhesive 46A (step S12 in FIG. 9B). Further, the flow channel plate 45 is bonded to the cover plate 43.

For example, in such a manner, it is possible to manufacture the inkjet head 4 according to the present embodiment.

[Basic Operation of Printer 1]

In the printer 1, the recording operation (a printing operation) of images, characters, and so on to the recording paper P is performed in the following manner. It should be noted that as an initial state, it is assumed that the four types of ink tanks 3 (3Y, 3M, 3C and 3B) shown in FIG. 1 are sufficiently filled with the ink 9 of the corresponding colors (the four colors), respectively. Further, there is achieved the state in which the inkjet heads 4 are filled with the ink 9 in the ink tanks 3 via the circulation mechanism 5, respectively.

In such an initial state, when operating the printer 1, the grit rollers 21 in the carrying mechanisms 2*a*, 2*b* each rotate to thereby carry the recording paper P along the carrying direction d (the X-axis direction) between the grit rollers 21 and the pinch rollers 22. Further, at the same time as such a carrying operation, the drive motor 633 in the drive mechanism 63 rotates each of the pulleys 631*a*, 631*b* to thereby operate the endless belt 632. Thus, the carriage 62 reciprocates along the width direction (the Y-axis direction) of the recording paper P while being guided by the guide rails 61*a*, 61*b*. Then, on this occasion, the four colors of ink 9 are appropriately ejected on the recording paper P by the respective inkjet heads 4 (4Y, 4M, 4C and 4B) to thereby perform the recording operation of images, characters, and so on to the recording paper P.

[Detailed Operation in Inkjet Head 4]

Then, the detailed operation (the jet operation of the ink 9) in the inkjet head 4 will be described with reference to FIG. 1 through FIG. 8, Specifically, in the inkjet heads 4 (the side-shoot type, the circulation type inkjet heads) according to the present embodiment, the jet operation of the ink 9 using a shear mode is performed in the following manner.

Firstly, when the reciprocation of the carriage 62 (see FIG. 1) described above is started, a control section 40 applies the drive voltages to the drive electrodes Ed (the common electrodes Edc and the active electrodes Eda) in the inkjet head 4 via the flexible printed circuit boards 44. Specifically, the control section 40 applies the drive voltage to the drive electrodes Ed disposed on the pair of drive walls Wd forming the ejection channel C1*e*, C2*e*. Thus, the pair of drive walls Wd each deform (see FIG. 5, FIG. 6 and FIG. 8) so as to protrude toward the non-ejection channel C1*d*, C2*d* adjacent to the ejection channel C1*e*, C2*e*.

As described above, due to the flexion deformation of the pair of drive walls Wd, the capacity of the ejection channel C1*e*, C2*e* increases. Further, due to the increase in the capacity of the ejection channel C1*e*, C2*e*, it results in that the ink 9 retained in the exit side common ink chamber 431 is induced into the ejection channel C1*e*, C2*e* (see FIG. 3).

Subsequently, the ink 9 having been induced into the ejection channel C1*e*, C2*e* in such a manner turns to a pressure wave to propagate to the inside of the ejection channel C1*e*, C2*e*. Then, the drive voltage to be applied to the drive electrodes Ed becomes 0 (zero) V at the timing at which the pressure wave has reached the nozzle hole H1, H2 of the nozzle plate 41. Thus, the drive walls Wd are restored from the state of the flexion deformation described above, and as a result, the capacity of the ejection channel C1*e*, C2*e* having once increased is restored again (see FIG. 5).

When the capacity of the ejection channel C1*e*, C2*e* is restored in such a manner, the internal pressure of the ejection channel C1*e*, C2*e* increases, and the ink 9 in the ejection channel C1*e*, C2*e* is pressurized. As a result, the ink 9 having a droplet shape is ejected (see FIG. 5, FIG. 6 and FIG. 8) toward the outside (toward the recording paper P) through the nozzle hole H1, H2. The jet operation (the ejection operation) of the ink 9 in the inkjet head 4 is performed in such a manner, and as a result, the recording operation of images, characters, and so on to the recording paper P is performed. In particular, the nozzle holes H1, H2 of the present embodiment each have the tapered shape gradually decreasing in diameter in the downward direction (see FIG. 5) as described above, and can therefore eject the ink 9 straight (good in straightness) at high speed. Therefore, it becomes possible to perform recording high in image quality.

[Functions and Advantages]

Then, the functions and the advantages of the head chip 4*c*, the inkjet head 4, and the printer 1 according to the embodiment of the present disclosure will be described.

In the head chip 4*c* according to the present embodiment, the common electrodes Edc each include the obverse surface side part Edc-u on the opening h1, h4 side, and the reverse surface side part Edc-d on the opening h5, h8 side, and the size in the Y-axis direction of the obverse surface side part Edc-u is made equal to the size in the Y-axis direction of the reverse surface side part Edc-d, or smaller than the size in the Y-axis direction of the reverse surface side part Edc-d. Thus, the increase in electrode area of the common electrode Edc can be suppressed compared to a head chip 104*c* (FIG. 13) according to the following comparative example.

Figure 13:
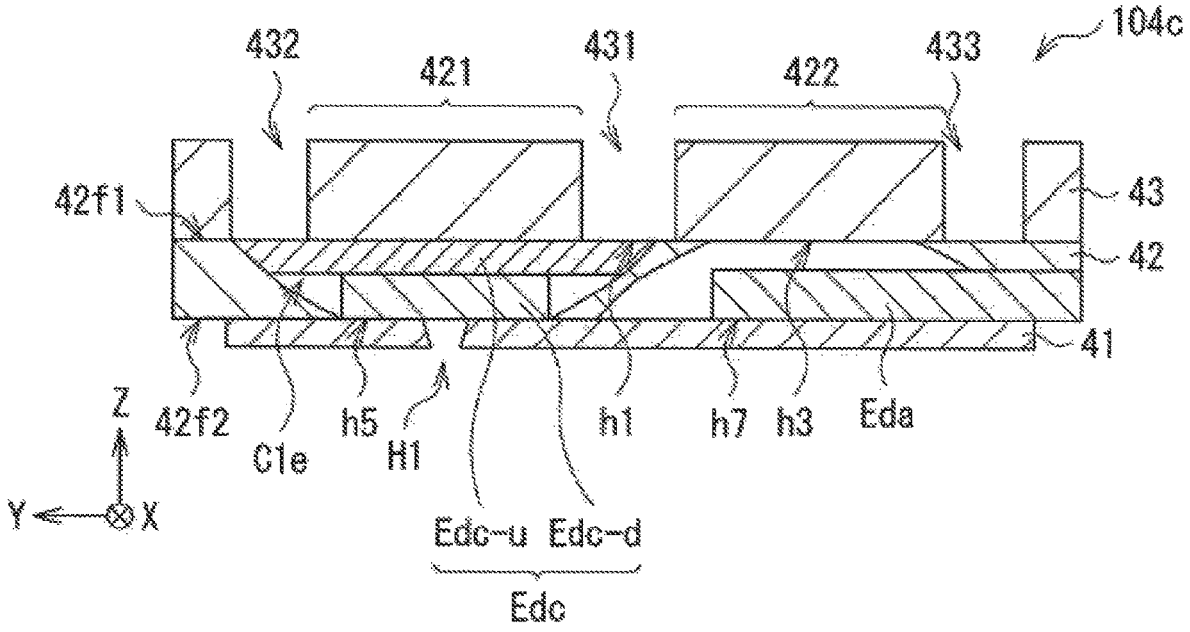
FIG. 13 is a schematic diagram showing a configuration of a substantial part of a liquid jet head related to a comparative example.

FIG. 13 shows a schematic cross-sectional configuration of a principal part of the head chip 104*c* according to the comparative example. In the head chip 104*c*, although the common electrode Edc includes the obverse surface side part Edc-u on the opening h1 side, and the reverse surface side part Edc-d on the opening h5 side, the size in the Y-axis direction of the obverse surface side part Edc-u is made larger than the size in the Y-axis direction of the reverse surface side part Edc-d. Such an obverse surface side part Edc-u is formed by, for example, evaporating the conductive material from the opening h1 side without providing the evaporation mask (e.g., the evaporation mask DM in FIG. 11A and FIG. 11B), and the size in the Y-axis direction of the obverse surface side part Edc-u is roughly the same as the size in the Y-axis direction of the opening h1.

Since such a common electrode Edc is large in the electrode area, the current amount and the power consumption are higher. In addition, since the amount of heat generation is also high, a failure of an electronic component such as the control section 40 is apt to be incurred. Further, the size in the Y-axis direction of the obverse surface side part Edc-u is made larger than the size in the Y-axis direction of the opening h5 on the nozzle hole H1 side. In other words, the common electrode Edc (the obverse surface side part Edc-u) is formed on the drive wall Wd of a part which does not make a contribution to the ejection, There is a possibility that the stray capacitance occurs due to the common electrode Edc in this part to generate an unintended drive of the drive wall Wd, namely a noise. The generation of the noise incurs a variation in ejection speed. Further, the cost increases due to gold (Au) constituting the common electrodes Edc.

In contrast, in the present embodiment, by disposing the evaporation mask DM in the both end parts in the Y-axis direction of the opening h1 when evaporating the conductive material on the inner side surfaces of each of the ejection channels C1*e*, C2*e* from, for example, the opening h1, h4 side, the size in the Y-axis direction of the obverse surface side part Edc-u is made equal to the size in the Y-axis direction of the reverse surface side part Edc-d, or smaller than the size in the Y-axis direction of the reverse surface side part Edc-d. Thus, the electrode area becomes smaller compared to the head chip 104*c*. Therefore, it becomes possible to suppress the increase in the current amount to suppress the power consumption. In addition, it becomes possible to reduce the amount of heat generation to keep the electronic component such as the control section 40 in good condition. Further, since the size in the Y-axis direction of the obverse surface side part Edc-u is equal to or smaller than the size in the Y-axis direction of the openings h5, h8, it is possible to suppress the generation of the noise caused by the stray capacitance. Therefore, the variation in ejection speed is reduced, and it becomes possible to improve the image quality. Further, it becomes possible to suppress the cost required for the common electrodes Edc.

Further, as described above, since the first evaporation part Edc-1 is not formed in the both end parts in the Y-axis direction of each of the openings h1, h4, it becomes difficult for the burrs to occur on the reverse surface 42*f*2 of the actuator plate 42 when forming (see FIG. 10E) the openings h5, h8 of the reverse surface 42*f*2 of the actuator plate 42. Therefore, it becomes possible to omit the removal process of the burrs to suppress the number of processes.

In particular, by covering the part where the depth Di of the first evaporation part Edc-1 becomes larger than the depth D of the ejection channels C1*e*, C2*e*, the burrs on the reverse surface 42*f*2 of the actuator plate 42 can more effectively be suppressed.

Further, in the head chip 4*c* according to the present embodiment, the common electrode Edc includes the first evaporation part Edc-1 formed by the evaporation from the opening h1, h4 side of the obverse surface 42*f*1, and the second evaporation part Edc-2 formed by the evaporation from the opening h5, h8 side of the reverse surface 42*f*2. Thus, compared to the case of forming the common electrode 42 from only either one of the obverse surface 42*f*1 side and the reverse surface 42*f*2 side, it is possible to cover the inner side surfaces (the drive walls Wd) continuously from the obverse surface 42*f*1 to the reverse surface 42*f*2 even in the case in which the plurality of ejection channels C1*e*, C2*e* each has a high aspect ratio. Therefore, the variation in the area of the common electrode Edc to be provided to the plurality of ejection channels C1*e*, C2*e* is reduced, and thus, it is possible to reduce the variation in ejection amount of the ink 9 and the ejection speed of the ink 9 from each of the ejection channels C1*e*, C2*e*.

Further, since it is arranged that the first evaporation part Edc-1 is evaporated from the obverse surface 42*f*1 (the opening h1, h4) side, and the second evaporation part Edc-2 is evaporated from the reverse surface 42*f*2 (the opening h5, h8) side, it is possible to homogenize each of the film quality of the first evaporation part Edc-1 and the film quality of the second evaporation part Edc-2, and it is possible to suppress the degradation of the film quality as a whole in the common electrode Edc.

Further, since the variation in the area of the common electrode Edc to be formed in the plurality of ejection channels C1*e*, C2*e* is reduced, the variation in the capacitance in the head chip 4*c* is reduced, and thus, the variation in temperature in the head chip 4*c* when ejecting the ink is reduced. As a result, the controllability by the temperature sensor is improved, and it is possible to reduce the variation in ejection amount of the ink 9 and ejection speed of the ink 9 from the ejection channels C1*e*, C2*e*.

As described above, in the head chip 4*c*, the inkjet head 4, and the printer 1 according to the present embodiment, since the size in the Y-axis direction of the obverse surface side part Edc-u of the common electrode Edc is made equal to the size in the Y-axis direction of the reverse surface side part Edc-d, or smaller than the size in the Y-axis direction of the reverse surface side part Edc-d, it is possible to suppress the increase in electrode area of the common electrode Edc. Therefore, it becomes possible to suppress the stray capacitance to improve the image quality. Further, it becomes possible to suppress the increase in the current amount to suppress the power consumption. Further, it becomes possible to suppress the cost required for the drive electrode Ed (the common electrodes Edc).

<2. Modified Example>

Then, a modified example of the embodiment described above will be described. It should be noted that substantially the same constituents as those in the embodiment are denoted by the same reference symbols, and the description thereof will arbitrarily be omitted.

Figure 14:
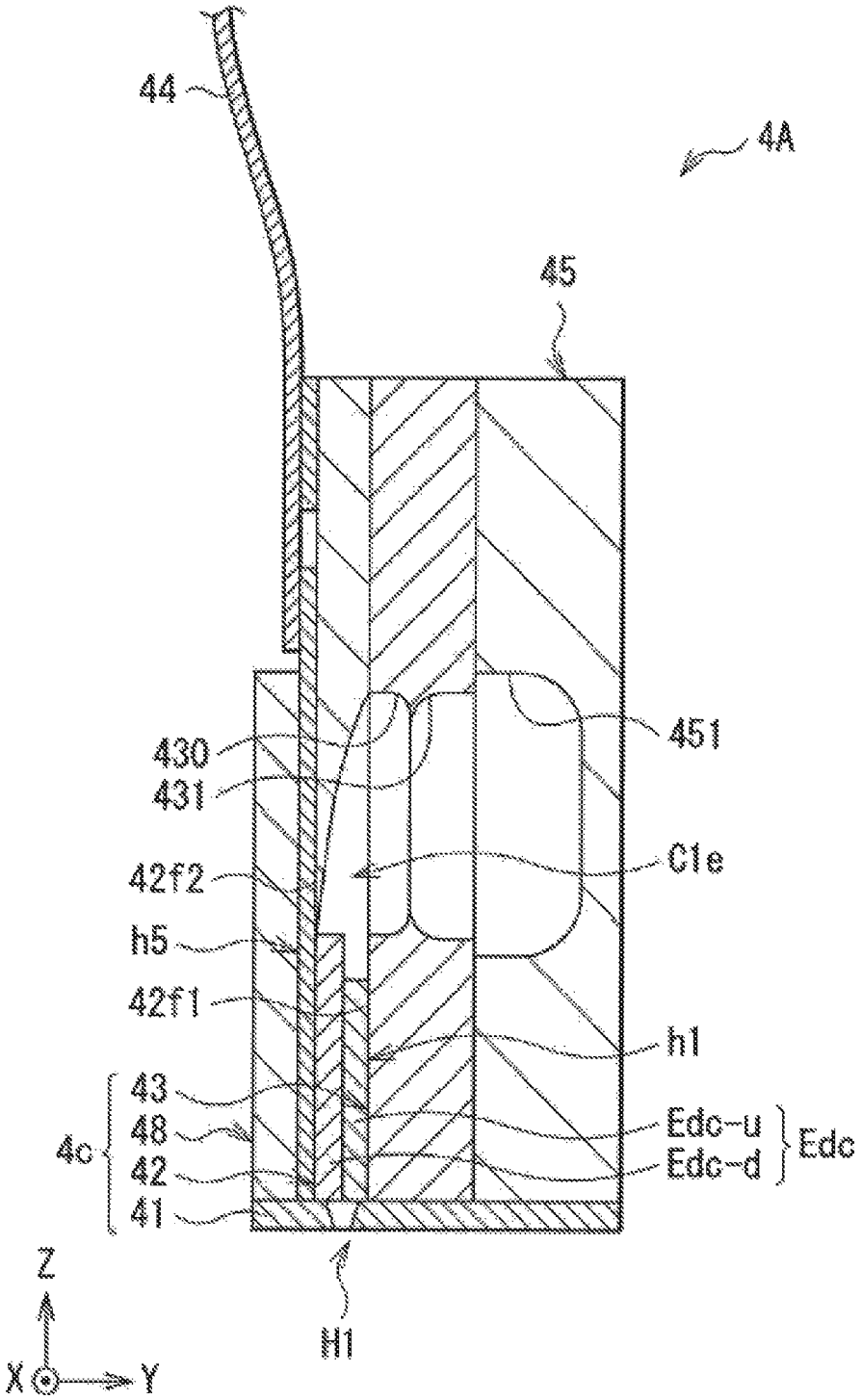
FIG. 14 is a schematic diagram showing a configuration of a substantial part of a liquid jet head related to a comparative example.

FIG. 14 shows a schematic cross-sectional configuration of a principal part of an inkjet head 4A according to the modified example of the embodiment described above. The inkjet head 4A includes the nozzle plate 41, the actuator plate 42, the cover plate 43, the flow channel plate 45, and a sealing plate 48. The inkjet head 4A is a so-called edge-shoot type inkjet head for ejecting the ink from a tip part in the extending direction (the Z-axis direction in FIG. 14) of the ejection channel C1*e*. Except this point, the configuration of the inkjet head 4A according to the modified example is substantially the same as the configuration of the inkjet head 4 described in the above embodiment, and can exert substantially the same advantages as those of the inkjet head 4 described in the above embodiment.

In the inkjet head 4A, the flow channel plate 45, the cover plate 43, the actuator plate 42, and the sealing plate 48 are disposed so as to be stacked on one another in this order, and the nozzle plate 41 is disposed roughly perpendicularly to these plates.

On the opposed surface of the flow channel plate 45 to the cover plate 43, there is disposed a supply side flow channel 451 to be communicated with a common ink chamber 431. The cover plate 43 has slits 430 communicated with the common ink chamber 431 and opening on the actuator plate 42 side. The plurality of slits 430 is provided to the cover plate 43, and is disposed at positions corresponding to the plurality of ejection channels C1*e*. The common ink chamber 431 is disposed commonly to the plurality of slits 430, and is communicated with the ejection channels C1*e* through the plurality of slits 430.

The sealing plate 48 is opposed to the cover plate 43 across the actuator plate 42. In other words, it is arranged that the plurality of ejection channels C1*e* and the plurality of dummy channels C1*d* are closed by the sealing plate 48 and the cover plate 43. The sealing plate 48 is not required to have an opening, a cutout, a groove, or the like. In other words, since it is sufficient for the sealing plate 53 to be a simple rectangular solid, it is possible to use a functional material difficult to fabricate, or a low-price material difficult to obtain high processing accuracy as the constituent material thereof. Therefore, the degree of freedom of selection of a material type is enhanced.

The actuator plate 42 has the obverse surface 42*f*1 opposed to the cover plate 43, and the reverse surface 42*f*2 opposed to the sealing plate 48. Similarly to the embodiment described above, the size in the extending direction (the Z-axis direction) of the ejection channel C1*e* of the opening h1 of the obverse surface 42*f*1 is made larger than the size in the Z-axis direction of the opening h5 of the reverse surface 42*f*2. In the common electrode Edc disposed on the inner side surface of the ejection channel C1*e*, the size in the Z-axis direction of the obverse surface side part Edc-u on the opening h1 side is made equal to the size in the Z-axis direction of the reverse surface side part Edc-d on the opening h5 side, or smaller than the size in the Z-axis direction of the reverse surface side part Edc-d. For example, the obverse surface side part Edc-u and the reverse surface side part Edc-d both extend in the Z-axis direction from an end part of the ejection channel C1*e* on the nozzle plate 41 side. In other words, the positions of the one end parts of the obverse surface side part Edc-u and the reverse surface side part Edc-d are roughly the same in the Z-axis direction. For example, the position of the other end part of the obverse surface side part Edc-u is disposed closer to the nozzle plate 41 than the position of the other end part of the reverse surface side part Edc-d in the Z-axis direction.

Such an edge-shoot type inkjet head 4A can also suppress the increase in the electrode area of the common electrode Edc by making the size in the Z-axis direction of the obverse surface side part Edc-u equal to the size in the Z-axis direction of the reverse surface side part Edc-d, or smaller than the size in the Z-axis direction of the reverse surface side part Edc-d.

<3. Other Modified Examples>

The disclosure is described hereinabove citing the embodiment, but the disclosure is not limited to the embodiment, and a variety of modifications can be adopted.

For example, in the embodiment described above, the description is presented specifically citing the configuration examples (the shapes, the arrangements, the number and so on) of each of the members in the printer 1 and the inkjet heads 4, 4A, but what is described in the above embodiment is not a limitation, and it is possible to adopt other shapes, arrangements, numbers and so on. Further, the values or the ranges, the magnitude relation and so on of a variety of parameters described in the above embodiment are not limited to those described in the above embodiment, but can also be other values or ranges, other magnitude relation and so on.

Specifically, for example, in the embodiment described above, the description is presented citing the inkjet head 4 of the two-column type (having the two nozzle columns 411, 412), but the example is not a limitation. Specifically, for example, it is also possible to adopt an inkjet head of a single-column type (having a single nozzle column), or an inkjet head of a multi-column type (having three or more nozzle columns) with three or more columns.

Further, for example, in the embodiment described above, there is described the case in which the nozzle columns 411, 412 each extend linearly along the X-axis direction, but this example is not a limitation. It is also possible to arrange that, for example, the nozzle columns 411, 412 each extend in an oblique direction. Further, the shape of each of the nozzle holes H1, H2 is not limited to the circular shape as described in the above embodiment, but can also be, for example, a polygonal shape such as a triangular shape, an elliptical shape, or a start shape.

Further, for example, although the case in which the circulation type is adopted in the inkjet heads 4 is described in the above embodiment, this example is not a limitation, and it is also possible to, for example, adopt other types without the circulation in the inkjet heads 4.

Further, in the above embodiment, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange to apply the "liquid jet head" (the inkjet head 4) and the "head chip" (the head chip 4*c*) of the present disclosure to other devices than the inkjet printer. Specifically, for example, it is also possible to arrange that the "liquid jet head" or the "head chip" of the present disclosure is applied to a device such as a facsimile or an on-demand printer.

Further, although the recording object of the printer 1 is the recording paper P in the embodiment and the modified example described above, the recording object of the "liquid jet recording device" according to the present disclosure is not limited to the recording paper P. It is possible to form characters and patterns by jetting the ink to a variety of materials such as cardboard, cloth, plastic or metal. Further, the recording object is not required to have a flat shape, and it is also possible to perform painting or decoration of a variety of 3D objects such as food, architectural materials such as a tile, furniture, or a vehicle. Further, it is possible to print fabric with the "liquid jet recording device" according to the present disclosure, or it is also possible to perform 3D shaping by solidifying the ink after jetted (a so-called a 3D printer).

Further, it is also possible to apply the variety of examples described hereinabove in arbitrary combination.

It should be noted that the advantages described in the specification are illustrative only but are not a limitation, and other advantages can also be provided.

Further, the present disclosure can also take the following configurations.

<1>

A head chip adapted to jet liquid comprising an actuator plate adapted to apply pressure to the liquid, wherein the actuator plate includes an obverse surface and a reverse surface; a channel extending in a predetermined direction, and having a first opening provided to the obverse surface and a second opening which is provided to the reverse surface and is shorter in length in the predetermined direction than the first opening; and an electrode having an obverse surface side part disposed on a sidewall of the channel on the first opening side, and a reverse surface side part which is disposed on the sidewall closer to the second opening than the obverse surface side part and is one of equal to and larger than the obverse surface side part in size in the predetermined direction.

<2>

The head chip according to <1>, wherein a size in the predetermined direction of the reverse surface side part is equal to a length in the predetermined direction of the second opening.

<3>

The head chip according to <1> or <2>, wherein a size in the predetermined direction of the obverse surface side part is smaller than the length in the predetermined direction of the second opening.

<4>

The head chip according to any one of <1> to <3>, further comprising a nozzle plate provided with a nozzle hole communicated with the channel.

<5>

A liquid jet head comprising the head chip according to any one of <1> to <4>; and a supply mechanism adapted to supply the liquid to the head chip.

<6>

A liquid jet recording device comprising the liquid jet head according to <5>; and a containing section adapted to contain the liquid.

<7>

A method of manufacturing a head chip having an actuator plate adapted to apply pressure to liquid so as to jet the liquid, the method comprising forming the actuator plate, the forming the actuator plate including providing a piezoelectric substrate having an obverse surface and a reverse surface with a channel which extends in a predetermined direction and has a first opening on the obverse surface; covering both end parts of the first opening in the predetermined direction with a mask; evaporating a conductive material on a sidewall of the channel from the first opening provided with the mask so as to form a first evaporation part; grinding the reverse surface of the piezoelectric substrate so as to reach the channel, to thereby form a second opening shorter in length in the predetermined direction than the first opening on the reverse surface side of the piezoelectric substrate; and evaporating the conductive material on the sidewall of the channel from the second opening so as to form a second evaporation part, to thereby form an electrode including the first evaporation part and the second evaporation part.

<8>

The method of manufacturing the head chip according to <7>, wherein the forming the actuator plate further includes forming a resist film on the obverse surface of the piezoelectric substrate after forming the channel, and the first evaporation part is formed after forming the resist film.

<9>

The method of manufacturing the head chip according to <8>, wherein the both end parts include a part where a depth Di of the first evaporation part expressed by a following formula (1) is larger than a depth D of the channel.

$$Di=s/\tan(\beta-\theta)-r \quad (1)$$

where s: a width of the channel

β: an incident angle of the evaporation when forming the first evaporation part

θ: a tilt angle of the piezoelectric substrate r: a thickness of the resist film

<10>

The method of manufacturing the head chip according to any one of <7> to <9>, further comprising bonding a cover plate to the obverse surface of the piezoelectric substrate after forming the first evaporation part, wherein after bonding the cover plate to the obverse surface of the piezoelectric substrate, the reverse surface of the piezoelectric substrate is ground so as to form the second opening.

What is claimed is:

1. A head chip adapted to jet liquid comprising an actuator plate adapted to apply pressure to the liquid, wherein the actuator plate includes:

an obverse surface and a reverse surface;

a channel extending in a predetermined direction, and having a first opening provided to the obverse surface and a second opening which is provided to the reverse surface and is shorter in length in the predetermined direction than the first opening; and an electrode having an obverse surface side part disposed on a sidewall of the channel on the first opening side, and a reverse surface side part which is disposed on the sidewall closer to the second opening than the obverse surface side part and is one of equal to and larger than the obverse surface side part in size in the predetermined direction.

2. The head chip according to claim 1, wherein a size in the predetermined direction of the reverse surface side part is equal to a length in the predetermined direction of the second opening.

3. The head chip according to claim 1, wherein a size in the predetermined direction of the obverse surface side part is smaller than the length in the predetermined direction of the second opening.

4. The head chip according to claim 1, further comprising a nozzle plate provided with a nozzle hole communicated with the channel.

5. A liquid jet head comprising:

the head chip according to claim 1; and a supply mechanism adapted to supply the liquid to the head chip.

6. A liquid jet recording device comprising:

the liquid jet head according to claim 5; and a containing section adapted to contain the liquid.

7. A method of manufacturing a head chip having an actuator plate adapted to apply pressure to liquid so as to jet the liquid, the method comprising forming the actuator plate, the forming the actuator plate including:

providing a piezoelectric substrate having an obverse surface and a reverse surface with a channel which extends in a predetermined direction and has a first opening on the obverse surface;

covering both end parts of the first opening in the predetermined direction with a mask;

evaporating a conductive material on a sidewall of the channel from the first opening provided with the mask so as to form a first evaporation part;

grinding the reverse surface of the piezoelectric substrate so as to reach the channel, to thereby form a second opening shorter in length in the predetermined direction than the first opening on the reverse surface side of the piezoelectric substrate; and evaporating the conductive material on the sidewall of the channel from the second opening so as to form a second evaporation part, to thereby form an electrode including the first evaporation part and the second evaporation part.

8. The method of manufacturing the head chip according to claim 7, wherein the forming the actuator plate further includes forming a resist film on the obverse surface of the piezoelectric substrate after forming the channel, and the first evaporation part is formed after forming the resist film.

9. The method of manufacturing the head chip according to claim 8, wherein the both end parts include a part where a depth Di of the first evaporation part expressed by a following formula (1) is larger than a depth D of the channel:

$$Di=s/\tan(\beta-\theta)-r \quad (1)$$

where s: a width of the channel

β: an incident angle of the evaporation when forming the first evaporation part

θ: a tilt angle of the piezoelectric substrate r: a thickness of the resist film.

10. The method of manufacturing the head chip according to claim 7, further comprising bonding a cover plate to the obverse surface of the piezoelectric substrate after forming the first evaporation part, wherein after bonding the cover plate to the obverse surface of the piezoelectric substrate, the reverse surface of the piezoelectric substrate is ground so as to form the second opening.

* * * * *